US007961099B2

(12) United States Patent
Rendon et al.

(10) Patent No.: US 7,961,099 B2
(45) Date of Patent: Jun. 14, 2011

(54) TAMPER-RESISTANT ARTICLE SECURITY DEVICE AND METHOD

(75) Inventors: Oscar Rendon, Coral Springs, FL (US); Gilbert Fernandez, Jr., Weston, FL (US); Luis E. Anderson, Boca Raton, FL (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 344 days.

(21) Appl. No.: 12/178,253

(22) Filed: Jul. 23, 2008

(65) Prior Publication Data

US 2008/0289372 A1 Nov. 27, 2008

Related U.S. Application Data

(63) Continuation-in-part of application No. 11/792,632, filed as application No. PCT/US2005/044688 on Dec. 7, 2005.

(60) Provisional application No. 60/633,813, filed on Dec. 7, 2004, provisional application No. 60/683,657, filed on May 23, 2005, provisional application No. 60/967,416, filed on Sep. 4, 2007, provisional application No. 61/028,367, filed on Feb. 13, 2008.

(51) Int. Cl.
*G08B 13/14* (2006.01)

(52) U.S. Cl. ..... 340/572.1; 340/571; 340/572.8; 340/572.9; 24/704.1; 70/57; 215/201; D8/330; D8/332

(58) Field of Classification Search ..... 340/572.1, 340/571, 572.8, 572.9; 24/704.1; 70/57.1; 215/201, 212, 279; 292/256, 325; D8/330–332, D8/349; D10/104, 106
See application file for complete search history.

(56) References Cited

U.S. PATENT DOCUMENTS

| | | | | |
|---|---|---|---|---|
| 3,902,339 A | | 9/1975 | Carley et al. | |
| 4,827,577 A | | 5/1989 | Vaux | |
| 5,079,540 A | * | 1/1992 | Narlow et al. | 340/572.8 |
| 5,230,541 A | | 7/1993 | Nowak | |
| 5,931,031 A | | 8/1999 | Bouan | |
| 5,969,613 A | * | 10/1999 | Yeager et al. | 340/572.9 |

(Continued)

FOREIGN PATENT DOCUMENTS

EP 0615041 A1 9/1994

(Continued)

OTHER PUBLICATIONS

International Search Report and Written Opinion dated Dec. 19, 2008 for International Application No. PCT/2008/009217, International Filing Date Jul. 30, 2008 (13 pages).

(Continued)

*Primary Examiner* — Davetta W Goins
(74) *Attorney, Agent, or Firm* — Christopher & Weisberg, P.A.

(57) ABSTRACT

A method and device for protecting an article, wherein the security device has belt having a latch mating element. A magnetically actuable locking mechanism has a magnetically actuable latch and a flexible element. The magnetically actuable latch includes a lower surface having at least one protrusion extending there from and adapted to engage with the latch mating element of the belt, and a front surface adjacent the lower surface. The front surface has a lateral notch formed therein. The flexible element biases the magnetically actuable latch and the belt into a locked position. A housing has the magnetically actuable latch disposed therein and housing includes a passageway therein defining a belt pathway configured to slidingly receive the belt therein.

18 Claims, 16 Drawing Sheets

U.S. PATENT DOCUMENTS

| | | | | |
|---|---|---|---|---|
| 6,726,033 | B2 * | 4/2004 | Sparkowski et al. | 211/85.3 |
| 6,822,567 | B2 * | 11/2004 | Durbin | 340/568.1 |
| D506,694 | S * | 6/2005 | Corney | D10/104 |
| 6,912,878 | B2 * | 7/2005 | Belden, Jr. | 70/57.1 |
| 2007/0120701 | A1 | 5/2007 | Teller | |
| 2007/0163309 | A1 | 7/2007 | Fawcett et al. | |

FOREIGN PATENT DOCUMENTS

| | | | |
|---|---|---|---|
| EP | 1074682 | A1 | 2/2001 |
| FR | 2704592 | A1 | 11/1994 |
| JP | 2000009263 | A1 | 1/2000 |
| JP | 09100955 | A1 | 4/2009 |
| WO | 94/20712 | A1 | 9/1994 |
| WO | 01/00957 | A1 | 1/2001 |
| WO | 03046319 | A1 | 6/2003 |
| WO | 2006/063190 | A1 | 6/2006 |
| WO | 2006/063262 | A1 | 6/2006 |
| WO | 2006/063263 | A1 | 6/2006 |
| WO | 2006/063265 | A1 | 6/2006 |
| WO | 2006063264 | A1 | 6/2006 |
| WO | 2006/127674 | A1 | 11/2006 |
| WO | 2006/127925 | A2 | 11/2006 |

OTHER PUBLICATIONS

International Search Report and Written Opinion dated May 8, 2009 for International Application No. PCT/US2009/000270, International Filing Date Jan. 16, 2009 (13-pages).

International Search Report and Written Opinion dated May 2, 2006 for International Application No. PCT/US2006/044688, International Filing Date Dec. 7, 2005 (9-pages).

* cited by examiner

TAMPER-RESISTANT ARTICLE SECURITY DEVICE AND METHOD

CROSS-REFERENCE TO RELATED APPLICATION

This application is a Continuation-in-Part of U.S. patent application Ser. No. 11/792,632 entitled "Security Device for a Bottle" filed Jun. 7, 2007, which is a U.S. National Stage Application of PCT/US2005/044688 titled "Security Device for a Bottle", filed Dec. 7, 2005, which claims priority to U.S. Provisional Patent Application Ser. No. 60/633,813 titled "Improved EAS Security Tags" filed Dec. 7, 2004, and to U.S. Provisional Patent Application Ser. No. 60/683,657 titled "Improved EAS Security Tags" filed May 23, 2005. This application also claims priority to the U.S. Provisional Patent Application Ser. No. 60/967,416 titled "Security Device for a Bottle" filed Sep. 4, 2007, and to U.S. Provisional Patent Application Ser. No. 61/028,367 titled "Security Device, Spacer and System for Articles Having a Cylinder-Like Neck" filed Feb. 13, 2008, each of which are incorporated herein by reference in their entirety.

STATEMENT REGARDING FEDERALLY SPONSORED RESEARCH OR DEVELOPMENT n/a

FIELD OF THE INVENTION

The present invention relates generally to Electronic Article Surveillance ("EAS") systems for the prevention of unauthorized removal of an item from a controlled area, and more particularly to an EAS security tag having a tamper-resistant notch to prevent defeat and configured for attachment to bottles or other articles having a cylinder-like neck.

BACKGROUND OF THE INVENTION

A typical Electronic Article Surveillance ("EAS") system in a retail setting may comprise a monitoring system and one or more security tags or labels attached to articles to be protected from unauthorized removal. The monitoring system establishes a surveillance zone (also referred to as an interrogation zone), usually at an access point for the controlled area. Articles which are authorized for removal from the area can be deactivated or removed so as not be detectable by the monitoring system. If the monitored item enters the surveillance zone with an active security tag, an alarm may be triggered to indicate possible unauthorized removal of the item.

As is known in the art, security tags (also referred to as labels) for EAS systems can be constructed in any number of configurations. The desired configuration of the tag or label is often dictated by the nature of the article to be protected. For example, an EAS label may be enclosed in a rigid housing which can be secured to the monitored item, such as hard tags containing EAS labels which are commonly attached to clothing in retail stores. For pre-packaged goods which are subject to retail theft, such as CDs, DVDs, small electronic devices, etc., an EAS label may be disposed within the packaging in such a way that it is hidden from the consumer at least during the pre-purchase period.

Some types of non-packaged consumer products which are sold in a retail setting have irregular shapes which are not readily adaptable for one-size-fits-all EAS tagging methods. Examples of such articles are golf clubs and a glass bottle having a tapered neck and a closure cap such as those which may contain wine or liquor. The products contained in the glass bottles can be expensive, and they are often displayed unprotected on retail shelves where they can be manually retrieved by a consumer for purchase. In such a setting, the bottles are vulnerable to shoplifting. It is therefore desirable to provide an inexpensive EAS security device which is adapted for attachment to a glass bottle or other cylinder-like object.

However, thieves continue to develop ways to attempt to circumvent these EAS security devices. For example, a circular security device designed to surround the neck of a bottle or other cylindrical object, may use strap and housing or other arrangement which thieves may be to easily compromise to defeat the security device. Previously, such tampering has been prevented by adding additional parts which act as barriers to restrict the passage of unauthorized objects from reaching the latch mechanism. However, the additional of further parts increases the cost of the device and causes problems with reliability.

Various potential solutions to this vulnerability problem include reducing the clearance/space between the strap and the housing (thus reducing the clearance available for someone to insert an object), increasing the amount of force required to raise a latch, and providing empty cavities in the plastic housing strategically placed to guide and act as traps. However, each of these potential solutions presents additional concerns. For example, reducing the size of the belt pathway and/or increasing the size of the belt increases friction and interferes with the effective operation of the device. Increasing the amount of force required to raise the latch also interferes with the proper operation of the device since this frequently prevents the device from being opened using authorized means. Additionally, placing cavity traps within the housing is only effective for certain insertion angles and can easily be defeated (e.g., after repeated attempts).

Therefore, what is needed is an EAS security device that is adaptable to fit bottles and other cylinder-like objects having varying diameter necks and provisioned with a tamper-resistant notch to prevent defeat.

SUMMARY OF THE INVENTION

The present invention advantageously provides a method and security device for securing cylindrical objects. Generally, the present invention provides a security device having an annular opening and latching mechanism to securely fit around the outer diameter of a cylindrical object. The Security device may include an Electronic Article Surveillance ("EAS") tag.

One aspect of the present invention provides a security device with a belt having a latch mating element. A magnetically actuable locking mechanism has a magnetically actuable latch and a flexible element. The magnetically actuable latch includes a lower surface having at least one protrusion extending there from and adapted to engage with the latch mating element of the belt, and a front surface adjacent the lower surface. The front surface has a lateral notch formed therein. The flexible element biases the magnetically actuable latch and the belt into a locked position. A housing has the magnetically actuable latch disposed therein and housing includes a passageway therein defining a belt pathway configured to slidingly receive the belt therein.

In accordance with another aspect, the present invention provides a security device in which a belt has a latch mating element. A magnetically actuable locking mechanism includes a magnetically actuable latch and a flexible element to bias the magnetically actuable latch and the belt into a locked position. A housing has the magnetically actuable locking mechanism disposed therein. The housing including a passageway therein defining a belt pathway configured to slidingly receive the belt therein.

In accordance with another aspect, the present invention provides a method for protecting an object from theft. The method includes affixing a security device around a circumference of an article. The security device has a belt with a latch mating element. A magnetically actuable locking mechanism includes a magnetically actuable latch and a flexible element to bias the magnetically actuable latch and the belt into a locked position. A housing has the magnetically actuable locking mechanism disposed therein. The housing including a passageway therein defining a belt pathway configured to slidingly receive the belt therein. The belt securely encompasses the article when in the locked position.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Embodiments may be directed to apparatuses, systems and methods for pairing an article, such as a bottle, for example, with a security tag.

For example, one embodiment may include a security device comprising a locking mechanism, security tag, and a housing. The locking mechanism may comprise a magnetically actuable latch, a flexible element that biases the magnetically actuable latch toward a locking position, and a latch mating element that mates with at least a portion of the magnetically actuable latch in the locking position. As used herein, the "locking position" may refer to the position of the magnetically actuable latch in which it is partially or fully within a void of, in engagement with, joined with, or otherwise mated with the latch mating element. The housing may be a structure configured to partially or fully contain, enclose, or otherwise secure the locking mechanism, security tag, latch mating element, and the article to the housing. As secured, the magnetically actuable latch of the locking mechanism may mate with the latch mating element in the locking position to lock the housing, and thus the security tag with which the housing is secured, to the article. When the housing is locked, the security device may prevent or provide resistance to an attempt to separate the housing from the article. Another embodiment may include a security system comprising the security device and a detacher, which may be a device that includes a magnet. The detacher may be employed to unlock the housing by magnetically forcing the magnetically actuable latch away from the locking position.

It is worthy to note that any reference in the specification to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Numerous specific details may be set forth herein to provide a thorough understanding of the embodiments. It will be understood by those skilled in the art, however, that the embodiments may be practiced without these specific details. In other instances, well-known methods, procedures and components have not been described in detail so as not to obscure the embodiments. It can be appreciated that the specific structural and functional details disclosed herein may be representative and do not necessarily limit the scope of the embodiments.

Figure 1:
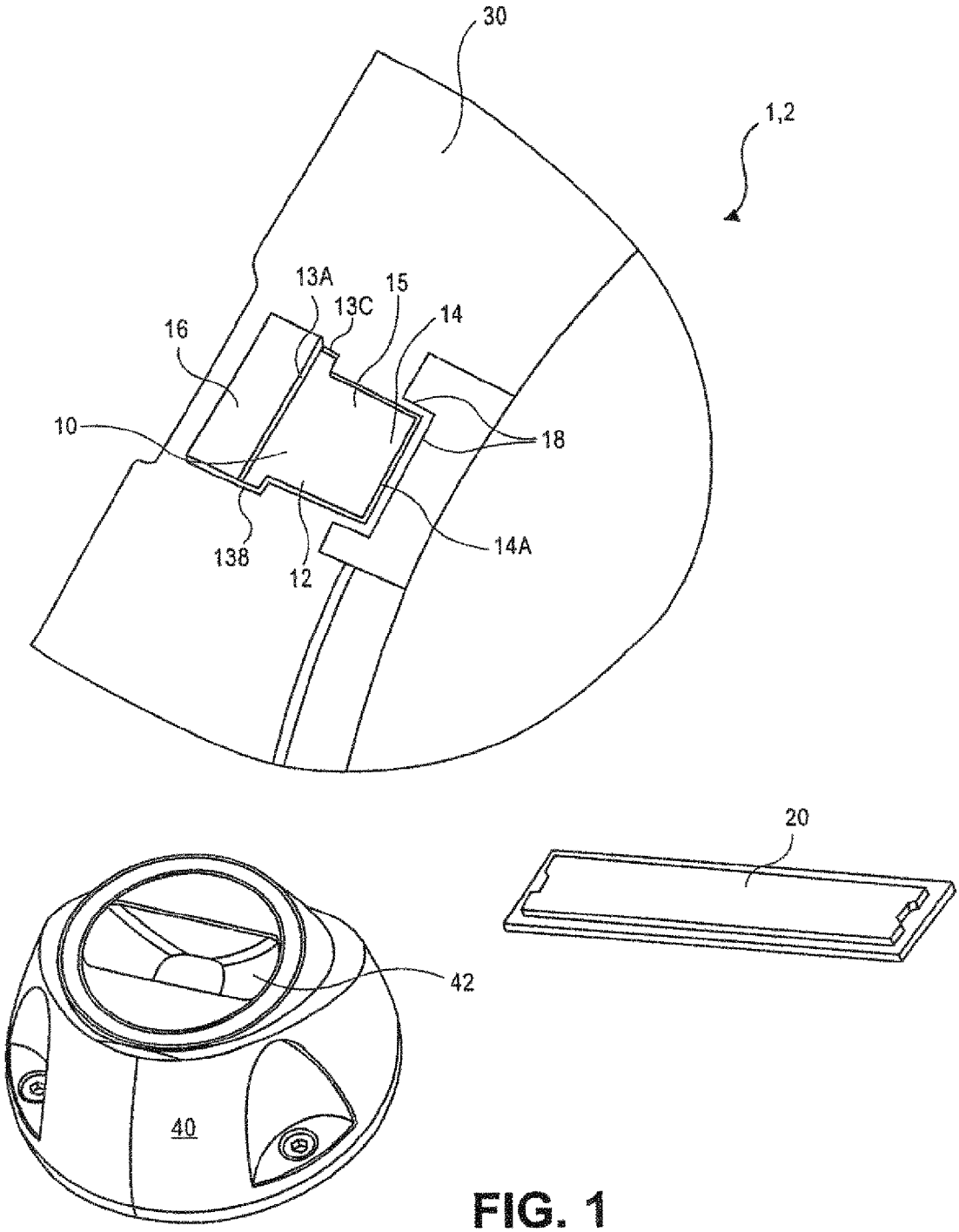
FIG. 1 illustrates components of a security device and system, in accordance with one embodiment.
Figure 2:
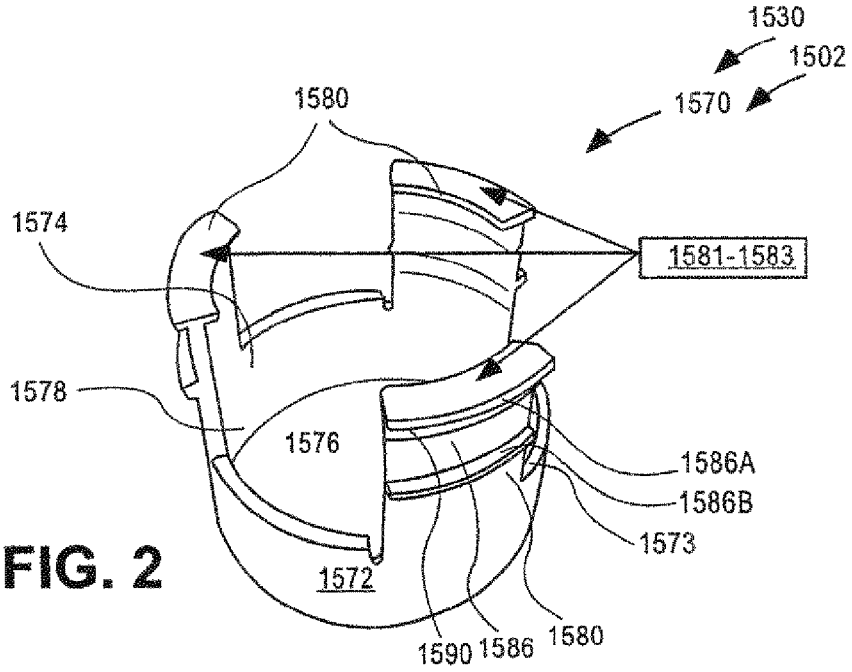
FIG. 2 illustrates a perspective view of a bottle cover, in accordance with one embodiment.
Figure 3:
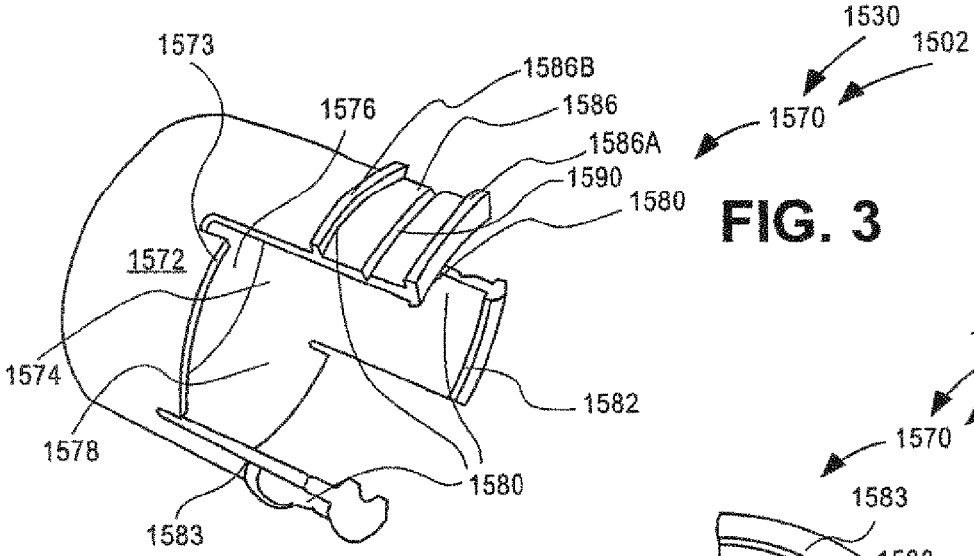
FIG. 3 illustrates a perspective view of a bottle cover, in accordance with one embodiment.
Figure 4:
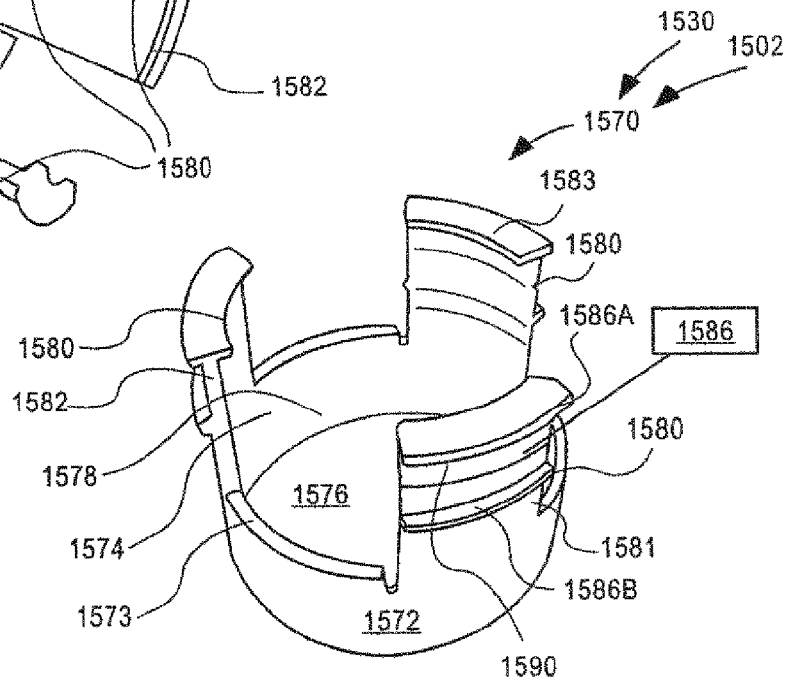
FIG. 4 illustrates a perspective view of a bottle cover, in accordance with one embodiment.
Figure 5:
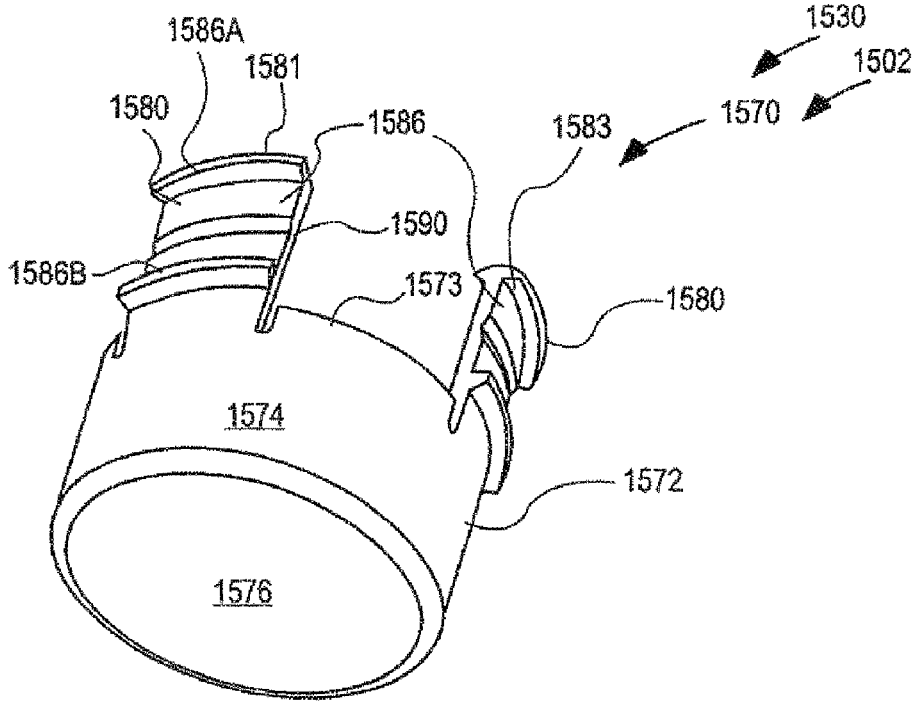
FIG. 5 illustrates a perspective view of a bottle cover, in accordance with one embodiment.
Figure 6:
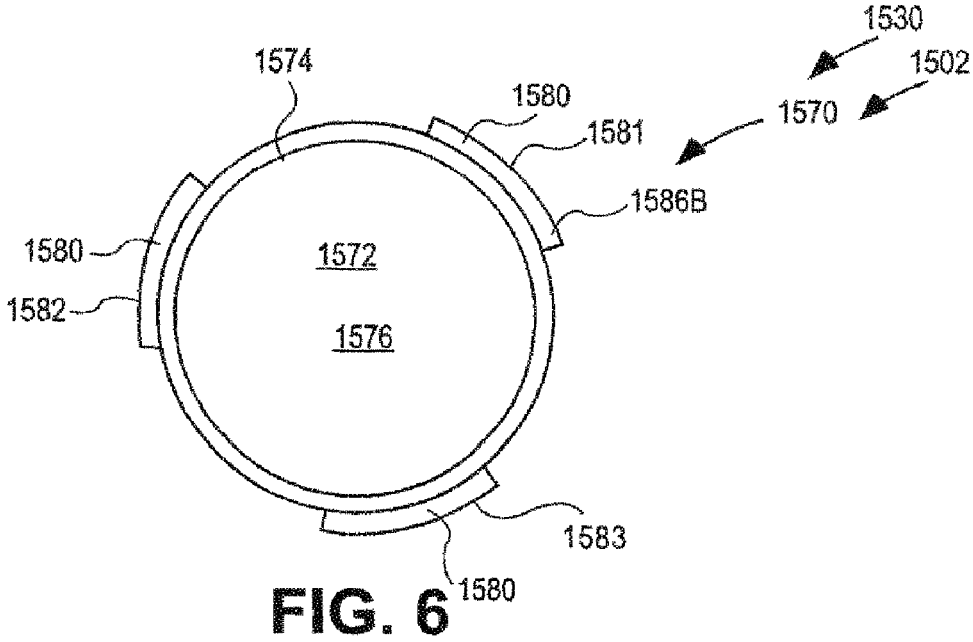
FIG. 6 illustrates a top view of a bottle cover, in accordance with one embodiment.
Figure 7:
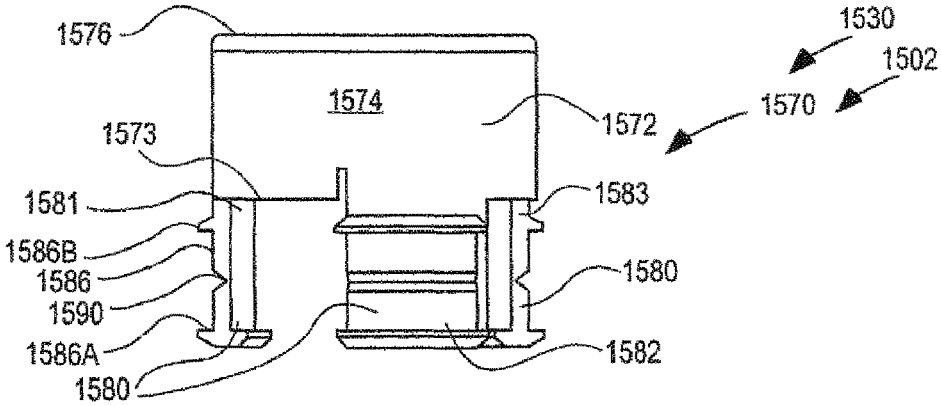
FIG. 7 illustrates a front view of a bottle cover, in accordance with one embodiment.
Figure 8:
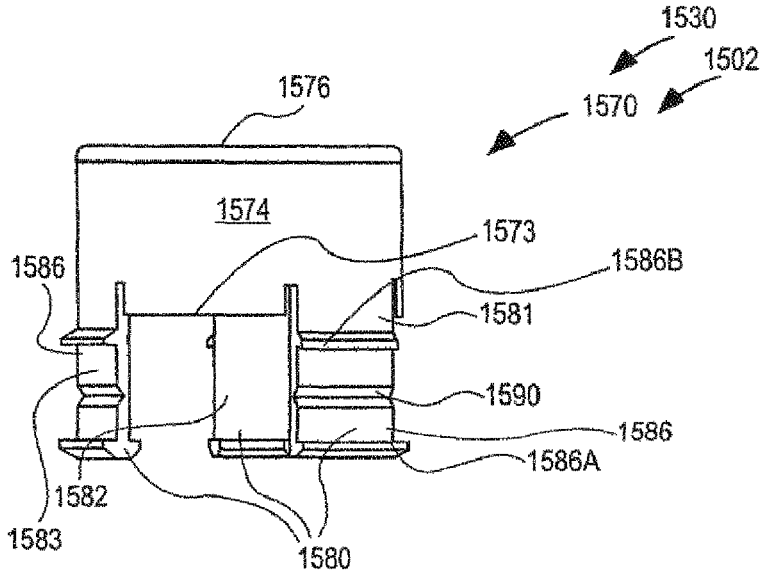
FIG. 8 illustrates a side view of a bottle cover, in accordance with one embodiment.
Figure 9:
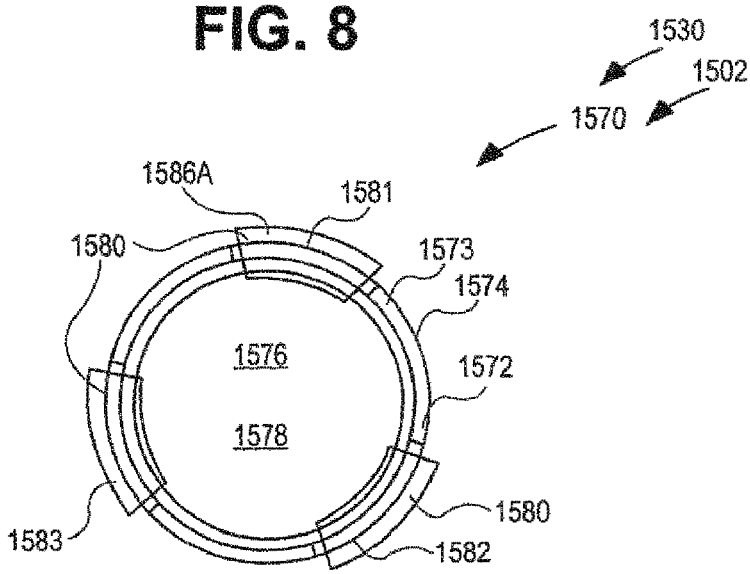
FIG. 9 illustrates a bottom view of a bottle cover, in accordance with one embodiment.

Referring now in detail to the drawings wherein like parts are designated by like reference numerals throughout, there is illustrated in FIG. 1 a front view of components that may be included in a security system 1 and a security device 2 in accordance with one embodiment. In this embodiment, the security system 1 includes the security device 2 and a detacher 40. The security device 2 may include a locking mechanism 10, security tag 20, and housing 30.

The locking mechanism 10 may be a magnetically actuable locking mechanism, and may include a magnetically actuable latch 12, flexible element 16, and latch mating element 18.

The magnetically actuable latch 12 may include a base portion 13, which may include a base portion end 13A and side surfaces 13B and 13C; and a latching portion 14, which may include a latching portion end 14A; and a central portion 15.

The magnetically actuable latch 12 may have a substantially rectangular-shaped face such that the base portion 13 has the same width as both the latching portion 14 and central portion 15. Thus, the width of the base portion 13, or the distance between the side surfaces 13B and 13C, may be the same as the corresponding widths of the latching portion 14 and central portion 15. In other embodiments, the widths of the base portion 13, latching portion 14, and central portion 15 may differ. The magnetically actuable latch 12 may have a slender, uniform cross-section.

However, the magnetically actuable latch 12 may be configured as desired, may comprise one or more pieces, and may be symmetrical or unsymmetrical about any point, line, or plane. For example, in various embodiments the magnetically actuable latch 12 may be configured with a "T", "I", curved, or other shape of face and with a rectangular, circular, thick, hollow or otherwise voided, and/or non-uniform cross-section, or as described herein with respect to embodiments of the magnetically actuable latch 12. In another embodiment, the latching portion end 14A of the magnetically actuable latch 12 may include one or more teeth, ribs, notches, jags, points, curves, voids, or other shapes such as those described herein with respect to embodiments of the magnetically actuable latch 12, while the base portion end 13A may be flat or another shape. In addition, the base portion end 13A may be continuous or discontinuous. The magnetically actuable latch 12 may be configured such that at least a portion of it, such as the latching portion 14, may engage, receive, insert into, or otherwise mate with the latch mating element 18, such as described herein.

In one embodiment, a security device 2 includes multiple magnetically actuable latches 12, which may be disposed, possibly each along with another flexible element 16 and latch mating element 18, in the same or different portions of the security device 2. For example, in one embodiment, the multiple magnetically actuable latches 12 may each cooperate with another portion of the security device 2 to lock the portion, such as, for example, a portion securing an article or a portion securing a security tag 20.

The magnetically actuable latch 12 may comprise or may be formed of a magnetic material such as iron, nickel, or cobalt, or an alloy of iron, nickel, or cobalt. In one embodiment, the magnetically actuable latch 12 includes one or more magnetic materials and may also include one or more non-magnetic materials.

The flexible element 16 may be shaped as desired, such as in a cuboid, ellipsoid, coil, or any other shape such as described herein with respect to the embodiments of the flexible elements 1516 and may include one or more pieces, or may be combined or integrally formed with the magnetically actuable latch 12. In one embodiment, the flexible element 16 may be shaped as a cantilever arm, such as, for example, a leaf spring. The flexible element 16 may comprise or may be formed of a flexible material such as a light, porous, semi-rigid, elastic, gaseous, and/or spongy material that may provide a resistant force when compressed and may partially or fully recover its uncompressed shape when the compressive force is removed. For example, in various embodiments, the flexible element 16 may comprise or may be formed of a foam rubber, polymeric foam, ceramic foam, or other foam; a rubber; and/or another material or materials. The flexible element 16 may also or alternatively be configured to provide the resistant force when compressed. For example, in various embodiments the flexible element 16 may be configured as a coil, leaf or other cantilevered arm, or other spring, or other like member, that comprises a metal, polymer, ceramic, and/or another material or materials. The flexible element 16 may have any of various masses.

The latch mating element 18 may be configured as desired, such as with one or more holes or other voids, ribs, teeth, protrusions, or other shapes. The latch mating element 18 may include one or more pieces, and may be separate from or integral with the housing 30, such as described herein. The latch mating element 18 may be configured to engage, receive, insert into, or otherwise mate with at least a portion of the magnetically actuable latch 12. For example, in an embodiment where the magnetically actuable latch 12 is a slender member with a rectangular shape of face, the latch mating element 18 may be configured with a void in which the latching portion 14 of the magnetically actuable latch 12 or a part thereof may be inserted into the locking position, as described herein. In an embodiment where the magnetically actuable latch 12 is toothed at its latching portion end 14A, the latch mating element 18 may be configured with ribs that engage the teeth in the locking position.

The security tag 20 may be any detectable device or system, such as any security tag or label. For example, in various embodiments the security tag 20 may be any type of EAS tag (e.g., Radio Frequency (RF) tag, acousto-magnetic tag, and/or combinations thereof), Radio Frequency Identification (RFID) tag, smart tag, or other detectable anti-theft or other tag. The security tag 20 may be detectable by a corresponding detecting system or device, such as, depending on the type of security tag or label, an acousto-magnetic detector, electromagnetic detector, radio frequency detector, or other detector.

The housing 30, as partially shown in the embodiment of FIG. 1, may be any casing or other structure that partially or fully contains and/or surrounds, encloses, affixes to, interlocks with, or otherwise secures the locking mechanism 10 and security tag 20, and, when the locking mechanism 10 is in the locking position and the housing is thereby locked, an article. The housing 30 and locking mechanism 10 may thus cooperate to secure, or lock, the article to the housing 30, and thus the security device 2. The housing 30 may be configured as desired, and may be shaped based upon the shapes of the locking mechanism 10, security tag 20, and article for which it is designed to secure, such as described below with respect to embodiments of the housing 1530 (See FIGS. 10-20). The housing 30 may include the latch mating element 18, which may be integral with the housing 30. The housing 30 may alternatively be configured to pair with the latch mating element 18. The housing 30 may comprise a polymer and/or another material or materials.

The components included in the security device 2 may be configured such that the security device 2 may lock to an article, such as described with respect to the security device embodiments below. The security tag 2 may be reusable or may be for one-time use.

FIGS. 2-5 illustrate perspective views of a bottle hat 1570, in accordance with one embodiment, and may be referred to where a corresponding element is discussed. The bottle hat 1570 may be shaped and sized to fit over at least a portion of a bottle, such as a wine, liquor, beer, perfume, cosmetic, or any other bottle, or any other container having a protruding neck-like structure with a mouth or other opening at its end. The bottle hat 1570 may include a cup 1572. The cup 1572 may be bounded by a side wall 1574 and a base 1576, which together may delineate a cup opening 1578. In one embodiment, the side wall 1574 is cylindrical and the top wall 1576 is transversely positioned adjacent the side wall 1574, delineating a cup opening 1578 having a substantially cylindrical shape.

However, in other embodiments, the side wall 1574 and base 1576 may be variously shaped and dimensioned, or the cup 1572 may have any other configuration sized to receive and contain at least a bottle mouth and any adjacent cap, cork, or other covering of the bottle mouth, or another element shaped like the bottle mouth and any adjacent covering. For example, in one embodiment, the cup 1572 may not include a base 1576, such as where the cup is dome shaped, for example. The cup 1572 may be further configured to contain some or all of any adjacent neck of the bottle through which its enclosed liquid may be released.

The bottle hat 1570 may also contain a receiving structure 1580 configured for receiving the belt assembly 1550. The receiving structure 1580 may extend from a lid 1573 of the cup 1572 opposite the end in which the base 1576 is positioned.

In one embodiment, this receiving structure 1580 includes one or more legs. In one embodiment, this receiving structure 1580 includes three legs 1581-1583 that extend from the lid 1573 and are sized and shaped to be disposed around at least a portion of the neck of a bottle. The legs 1581-1583 may have a similar structure and similarly extend from the cup 1572, and so only the leg 1581 is discussed herein. However, one or more of the legs 1581-1583 may be differently configured or absent in various embodiments. In another embodiment, a continuous structure or any other structure that may receive the belt assembly 1550 may substitute for the one or more legs 1581-1583.

The leg 1581 may form an extended portion of the side wall such that it has an arcuate shape. In an embodiment where the side wall 1574 is cylindrical, the leg 1581 may arc about a central axis of the side wall 1574 such that it has a similar or substantially the same radius with respect to the central axis as that of the side wall 1574. The leg 1581 may include a belt receiving channel 1586 having belt receiving channel walls 1586A and 1586B that may, in one embodiment, extend annularly from the central axis of the side wall 1574.

The belt receiving channel 1586 may include a groove 1590 in the belt receiving channel 1586, into which the belt assembly 1550 may at least partially extend, such as described below. The groove 1590 may extend along the belt receiving channel 1586 and may, in one embodiment, so extend such that it is equally spaced from the belt receiving channel walls 1586A and 1586B. In one embodiment, the groove has a "V" shape. In various other embodiments, the groove 1590 may have a different shape and positioning, and may be shaped and positioned to receive at least a portion of the belt assembly 1550, such as discussed below.

The bottle hat 1570 may be made of plastic or any other material or combination of materials. In one embodiment, the bottle hat 1570 comprises a rugged plastic. In another embodiment, the bottle hat may comprise an elastic material, such as a rubber, for example, or another material that may conform to the shape of the bottle neck or deform to fit around the bottle neck.

FIGS. 6-9 illustrate a top, front, side, and bottom view of the bottle hat 1570, in accordance with one embodiment. As shown, in an embodiment where the side wall 1574 of the bottle hat 1570 is cylindrical, the legs 1581-1583, if included, may have the same internal radius as that of the side wall 1574.

FIGS. 10-14 illustrate perspective views of a belt assembly 1550 or portion thereof, in accordance with one embodiment. The belt assembly 1550 may include a locking mechanism 1510, a security tag 1520, a housing 1530, and a security belt 1560. The locking mechanism 1510 may include a magnetically actuable latch 1512, a flexible element 1516, and a latch mating element 1518, such as described below.

Figure 12:
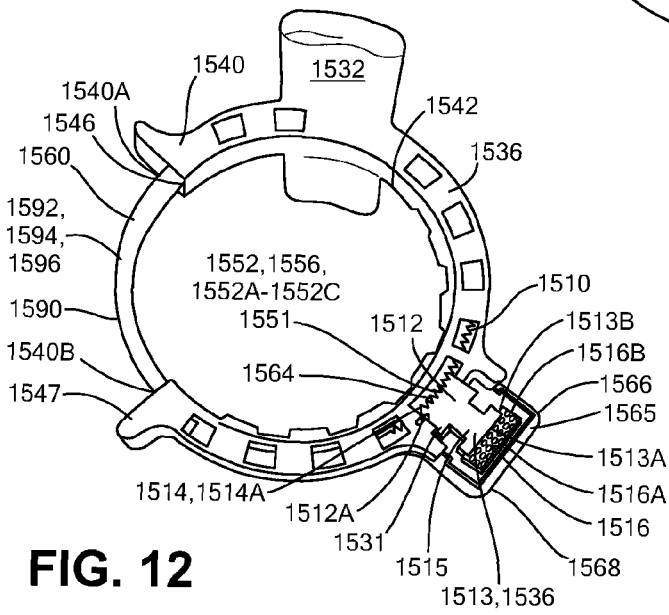
FIG. 12 illustrates a perspective view of a portion of a belt assembly, in accordance with one embodiment.
Figure 14:
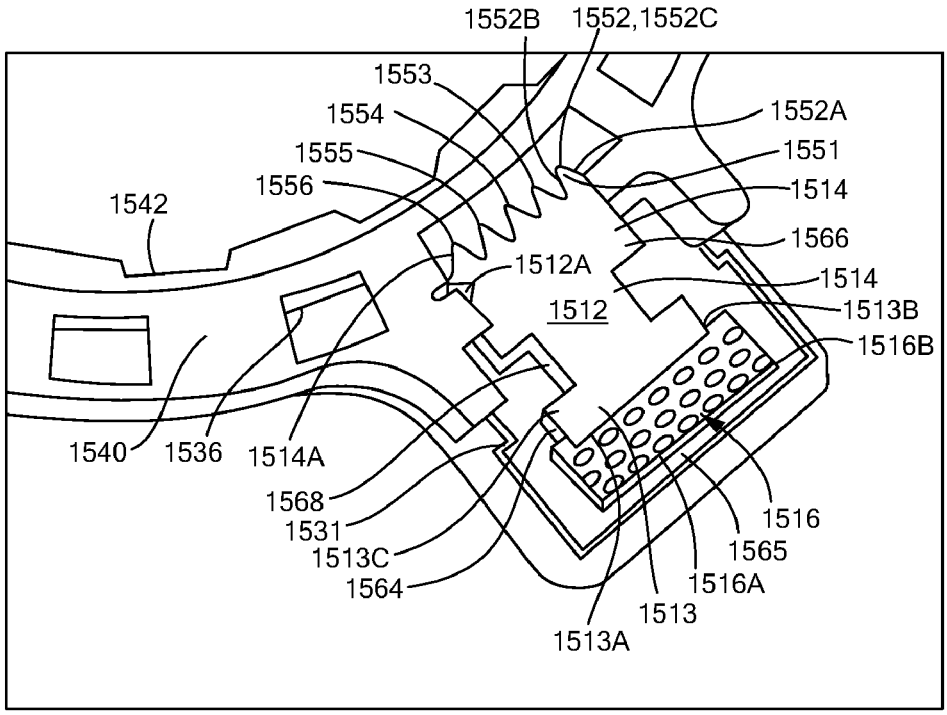
FIG. 14 illustrates a portion of a belt assembly including a magnetically actuable latch and a flexible element, in accordance with one embodiment.
Figure 15:
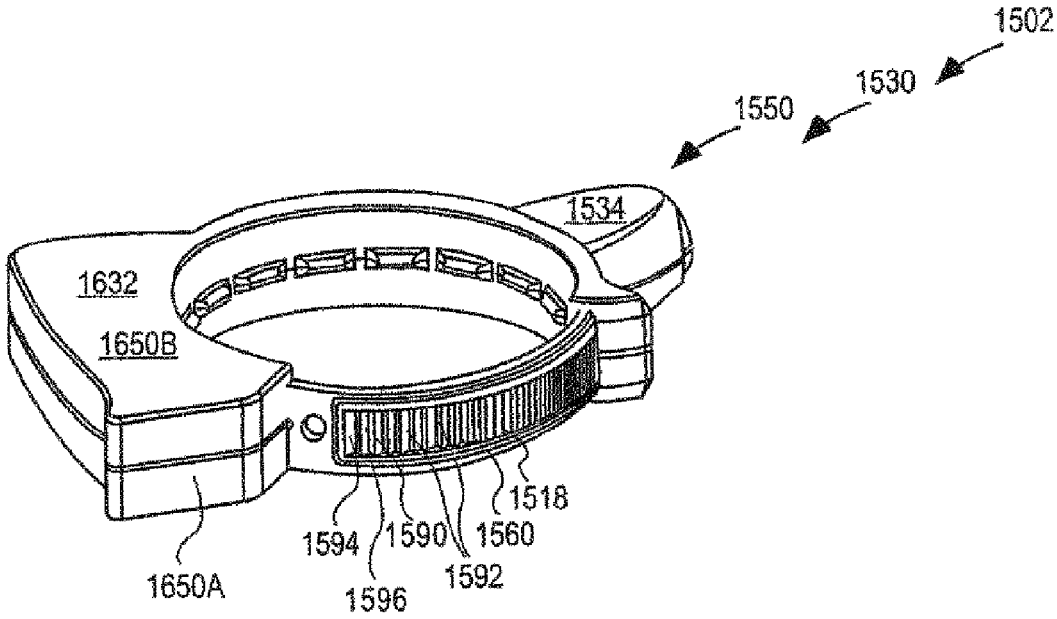
FIG. 15 illustrates a perspective view of a belt assembly, in accordance with one embodiment.
Figure 16:
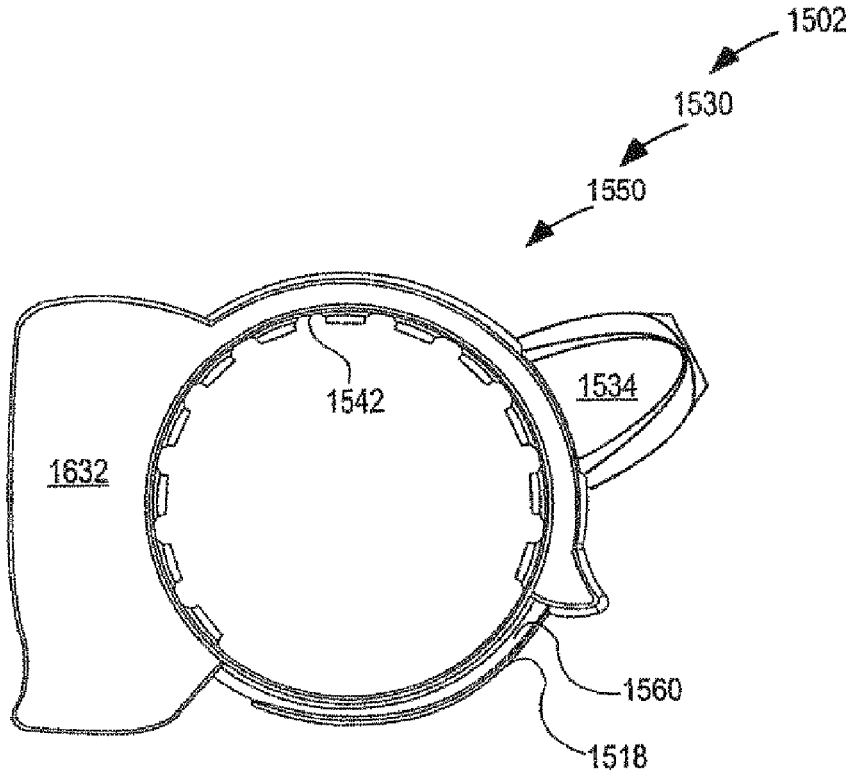
FIG. 16 illustrates a top view of a belt assembly, in accordance with one embodiment.
Figure 17:
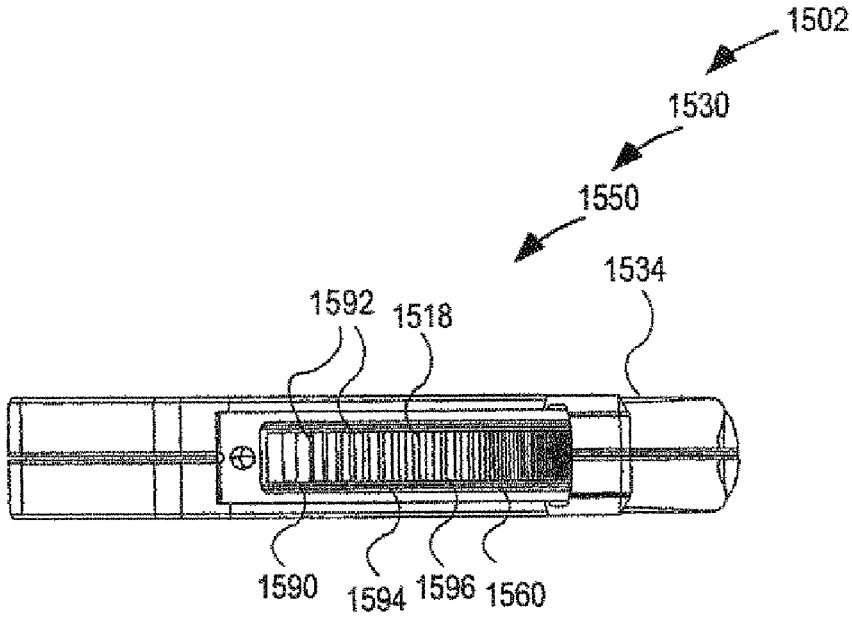
FIG. 17 illustrates a front view of a belt assembly, in accordance with one embodiment.
Figure 18:
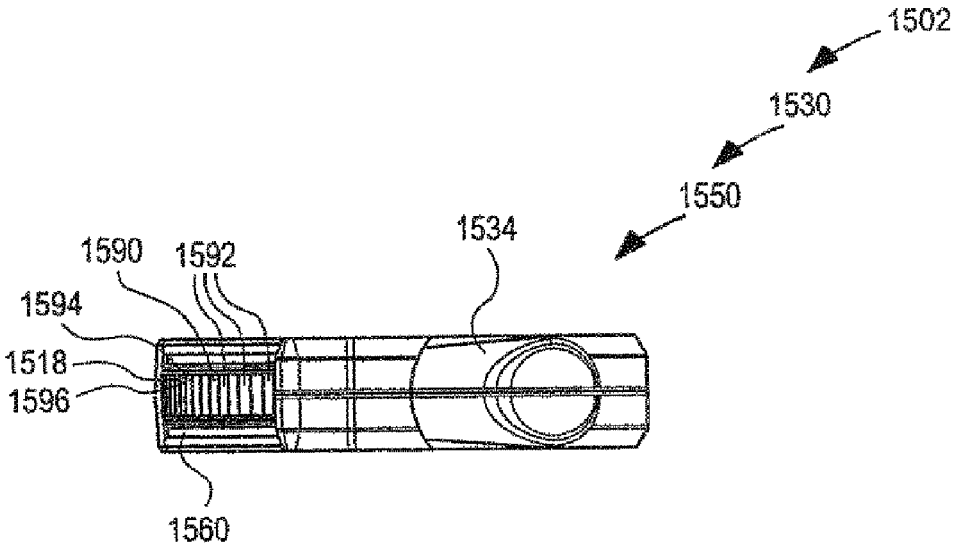
FIG. 18 illustrates a side view of a belt assembly, in accordance with one embodiment.

Reference is first made to FIGS. 12 and 14. FIG. 12 illustrates a perspective view of the belt assembly 1550 showing the magnetically actuable locking mechanism 1512 and the flexible element 1516 of the locking mechanism 1510 disposed in the locking mechanism pouch 1531, in accordance with one embodiment. FIG. 14 illustrates a perspective view of a portion of the housing including the magnetically actuable locking mechanism 1512 and the flexible element 1516, in accordance with one embodiment.

Referring to FIGS. 12 and 14, the magnetically actuable latch 1512 may comprise a magnetic material, and may comprise one or more materials, such as described with respect to the magnetically actuable latch 12 of FIG. 1. The magnetically actuable latch 1512 may include a base portion 1513, which may include a base portion end 1513A and base portion side surfaces 1513B and 1513C; a latching portion 1514, which may include a latching portion end 1514A; and a central portion 1515.

The magnetically actuable latch 1512 may be shaped at least partially like an "I" or a "T" or any other shape. Thus, the base portion side surfaces 1513B and 1513C may be parallel and each may be at least substantially straight. The width of the base portion 1513, which may be the distance between base portion side surfaces 1513B and 1513C, may be wider than the corresponding width of the central portion 1515 but similar to the corresponding width of the latching portion 1514. The base portion end 1513A may be flat and may be substantially perpendicular to the base portion side surfaces 1513B and 1513C. The magnetically actuable latch 1512 may be configured with a slender thickness.

The magnetically actuable latch 1512 may include one or more protrusions 1551. The one or more protrusions 1551 may be positioned at least partially in the latch portion 1514 of the magnetically actuable latch 1512, and may have ends at the latching portion end 1514A.

In one embodiment, the one or more protrusions 1551 may include one or more teeth. In one embodiment, for example, the protrusions 1551 may include five teeth 1552-1556 in one embodiment. The one or more teeth may also be viewed in the embodiment of FIG. 19. In this embodiment, the teeth 1552-1556 may have a similar structure and be similarly aligned in the magnetically actuable latch 1512. Therefore, only the tooth 1552 is discussed in detail below. However, one or more of the teeth 1552 may be differently configured or absent in various embodiments. The tooth 1552 may have sides 1552A and 1552B that may be relatively angled such that they meet at, or terminate near, the tooth end 1552C. The tooth end 1552C may thus be pointed.

The side 1552A may be at least substantially parallel to corresponding sides of teeth 1553-1556, as may be the side 1552B and the corresponding sides of 1553-1556. The side 1552A may be angled with respect to the base portion side surfaces 1513B-1513C of the base portion 1513 and/or the one or both of the corresponding sides of the latching portion 1514 and central portion 1515 of the magnetically actuable latch 1512. The side 1552B may be substantially perpendicular or less angled (than the side 1552A) with respect to the base portion side surfaces 1513B-1513C of the base portion 1513 and the corresponding sides of the latching portion 1514 and central portion 1515. The teeth 1552-1556 may be equally spaced or non-uniformly spaced. In one embodiment, the angles in the tooth sides 1552A and 1552B may vary in different teeth, or any combination of angles may be used.

However, the one or more protrusions 1551 may comprise other configurations. For example, the one or more protrusions 1551 may comprise one or more ribs, notches, jags, points, curves, or voids, for example. The one or more protrusions 1551 may be positioned at least partially on the latching portion 1514 of the latch and may comprise the latching portion end 1514A. The one or more protrusions 1551 may be configured to mate with the latch mating element 1518 in the locking position, such as described below.

The magnetically actuable latch 1512 can also be configured to prevent the insertion of an unauthorized object into the belt path 1536 in an attempt to displace the magnetically actuable latch 1512 from the locked position. In the illustrated embodiment, the magnetically actuable latch 1512 includes a tamper defeat notch 1512A (FIGS. 12 and 14) which prevents the manipulation of an intrusive implement within the device. The function of the tamper-defeat notch 1512A is described in detail hereinafter.

The magnetically actuable latch 1512 may be otherwise configured in various embodiments, such as described herein with respect to the magnetically actuable latch 12 shown in FIG. 1.

The flexible element 1516 may comprise or be formed of a flexible material, and may include a material or materials such as described herein with respect to the flexible element 16 shown in FIG. 1. The flexible element 1516, in one embodiment, may be configured with a substantially cuboidal shape such that its side 1516A is wider than its side 1516B, or may have another shape. In various other embodiments, the flexible element 1516 may be configured as, and comprise one or more materials of, a coil or other spring or like member, such as described above with respect to the magnetically actuable latch 12 of FIG. 1.

The latch mating element 1518 may be included in the security belt 1560, and may be separate from or integral with the housing 1530. The latch mating element 1518 may extend along the security belt 1560, such as described herein. In one embodiment, the latch mating element 1518 may include one or more voids 1590. In one embodiment, the magnetically actuable latch 1512 may mate with the latch mating element 1518 in the locking position when the one or more teeth or other protrusions 1551 extend into the one or more voids 1590.

The one or more voids 1590 may be delineated by one or more juts 1592, which may be protrusions such as described herein with respect to the protrusions 1551. The juts 1592 may also be viewed in the embodiment of FIGS. 15 and 17-19. The one or more juts 1592 may each comprise jut sides 1594 and 1596, which may be non-parallel in one embodiment. For example, in one embodiment, the jut sides 1594 may be substantially perpendicular or close to perpendicular to the tangential direction along the length of the latch mating element 1518, whereas the jut sides 1596 may have an angle that is that is acute, such as 45 degrees for example, relative to this length. Such a configuration may facilitate urging the latch mating element 1518 further into the housing 1530 and along the belt path 1536 in one direction but not the other, opposing direction, such as described below.

However, the latch mating element 1518 may be otherwise configured, such as with one or more ribs, notches, jags, points, curves, or voids, for example, to mate with the magnetically actuable latch 1512 in the locking position. For example, in one embodiment, the latch mating element 1518 may be configured with one or more voids 1590 shaped like or somewhat like that of the one or more protrusions 1551 of the magnetically actuable latch 1512. Thus, at least one void 1590 may receive at least one protrusion 1551 or a portion thereof, which may prevent or inhibit movement of the latch mating element 1518 along the belt path 1536 and out of the end 1540B of the belt path wall 1540 and thus the belt path 1536, such as described below.

In one embodiment, the latch mating element 1518 is deformable and may include a plastic or a rubber, for example. Such a deformable property may facilitate moving the latch mating element 1518 against the magnetically actuable latch 1512 as described below.

In another embodiment, the latch mating element 1518 comprises a penetrable material such as rubber or a soft plastic, and the magnetically actuable latch 1512 may include protrusions 1551, such as pointed teeth. These protrusions may dig into the latch mating element 1518 where the magnetically actuable latch 1512 is in the locking position and the latch mating element 1518 may thus provide resistance to a force urging movement out of the end 1540B of the belt path 1536.

Figure 10:
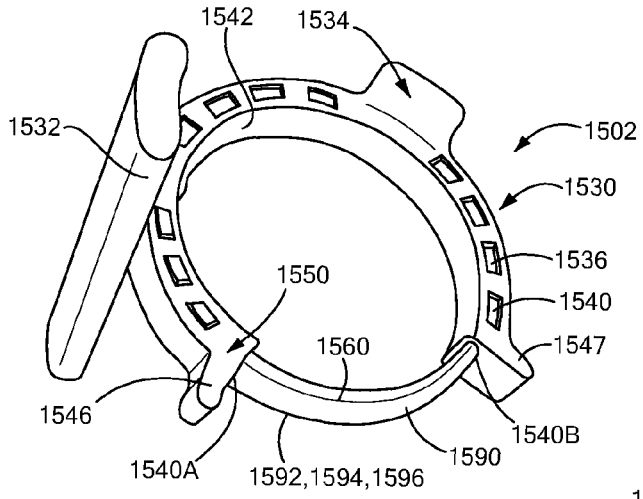
FIG. 10 illustrates a perspective view of a belt assembly, in accordance with one embodiment.
Figure 11:
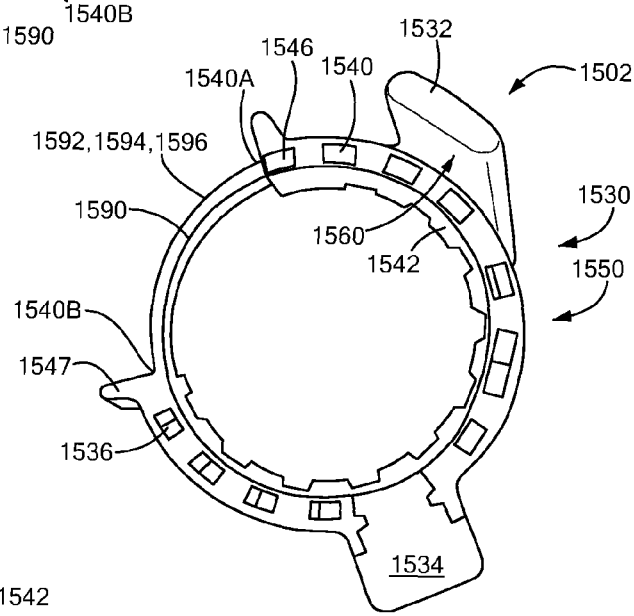
FIG. 11 illustrates a perspective view of a belt assembly, in accordance with one embodiment.

Referring to FIGS. 10 and 11, which illustrate perspective views of a belt assembly 1550 of the housing 1530 may include one or more of a locking mechanism pouch 1531, security tag chamber 1532, locking mechanism cover 1534, and belt path 1536 configured to receive a locking mechanism 1510 portion, cover the locking mechanism pouch 1531, receive the security tag 1520, cover the locking mechanism pouch 1531, and receive the security belt 1560, respectively.

The locking mechanism pouch 1531 may be shaped to receive the magnetically actuable latch 1512 and flexible element 1516 of the locking mechanism 1510. In one embodiment, the locking mechanism pouch 1531 is secured to and extends from the belt assembly 1550. The locking mechanism pouch 1531 may be integral with the belt path 1536 or other portion of the housing 1530 or otherwise secured thereto, such as by welding, fusing, gluing, snap-fit, interference fit, and/or by other securing means.

The locking mechanism pouch 1531 of the belt assembly 1550 may be configured such that the magnetically actuable latch 1512 and flexible element 1516 of the locking mechanism 1510 may be adjacently disposed therein. Thus, the base portion end 1513A of the magnetically actuable latch 1512 may be positioned near or in abutment with the flexible element 1516. With such a configuration, the movement of the magnetically actuable latch 1512 and flexible element 1516 may be restricted in one or more directions.

For example, the locking mechanism pouch 1531 may include a channel end wall 1565, channel walls 1566 and 1568, and a channel 1564 delineated by channel walls 1566 and 1568 and bounded by the channel end wall 1565. The channel walls 1566 and 1568 may include portions substantially parallel to each other, and may be positioned close to or in contact with the magnetically actuable latch 1512 at the base portion side surfaces 1513B and 1513C and at the sides of the central and latching portions 1515 and 1514, respectively, thereby restricting the movement of the magnetically actuable latch 1512 to movement along the channel 1564, which may be movement in a substantially linear direction, for example.

In various other embodiments, the magnetically actuable latch 1512 may move in a rotational, combination rotational/linear direction, or any other direction or directions. In these various other embodiments, one or more of the channel 1564, flexible element 1516, and latch mating element 1518 may be contoured, shaped, or otherwise configured to guide the magnetically actuable latch 1512 in the direction or directions.

The flexible element 1516 may be positioned adjacent the channel end wall 1565 such that where the magnetically actuable latch 1512 is forced away from the locking position and against the flexible element 1516, the flexible element 1516 may compress by the force of the magnetically actuable latch 1512 and the resistant force of the channel end wall 1565. The flexible element 1516 may provide a resistant force to such compression, against such movement of the magnetically actuable latch 1512.

As described above, in each of various embodiments the magnetically actuable latch 1512 may be configured with another shape, in which case the channel 1564, and thus the channel walls 1566 and 1568, may be configured to accommodate such a magnetically actuable latch 1512 and possibly restrict the movement of the magnetically actuable latch 1512 in one or more directions. In each of these embodiments, the flexible element 1516 may be configured to fit within the channel 1564.

Thus, the flexible element 1516 of the locking mechanism 1510 may bias the magnetically actuable latch 1512 into the locking position where the teeth 1552-1556 or other one or more protrusions 1551 of the magnetically actuable latch 1512 may engage the juts 1592 of the latch mating element 1518 portion disposed in the belt path 1536 of the belt assembly 1550. Such a configuration may prevent or provide resistance to movement of the latch mating element 1518 out of the belt path 1536 and thus the security device 1502.

For example, in one embodiment, where a tooth 1552 of the magnetically actuable latch 1512 is disposed in the locking position between two juts 1592, the adjacent jut side 1594 may be substantially parallel or have a small angle relative to the tooth side 1552B. But the jut side 1594 and tooth side 1552B may be substantially perpendicular or close to perpendicular to the direction in which the latch mating element 1518 moves by via the belt path 1536 as constrained by the belt path walls 1540. Thus, where a force is applied to the latch mating element 1518 to pull it out of the belt path 1536, the latch mating element 1518 may move until the jut side 1594 and tooth side 1552B contact and exert opposing substantially or close to normal forces on each other. In such case, the latch mating element 1518 may be prevented or inhibited from being pulled out of the belt path 1536.

However, in one embodiment, such a configuration may not prevent or may provide less resistance to movement of the latch mating element 1518 into and along the belt path 1536 of the belt assembly 1550. Thus, the tooth side 1552A and adjacent jut side 1596 may be angled relative to the direction of movement of the latch mating element 1518 along the belt path 1536. Where a force is applied to the latch mating element 1518 to urge it further into and along the belt path 1536, the latch mating element 1518 may move until the jut side 1596 and tooth side 1552A contact. In such case, the jut side 1596 may urge the tooth side 1552A and thus the appended tooth 1552 and magnetically actuable latch 1512 away from the locking position, facilitating moving the latch mating element 1518 along the belt path.

Additionally, when the jut side 1596 and tooth side 1552A contact, these elements may exert much lesser opposing normal forces than those of the jut side 1594 and tooth side 1552B, and if the outer material of the latch mating element 1518 is deformable as discussed herein, the latch mating element 1518 may be more easily moved. Movement may be made by a force greater than any normal force, plus other forces such as discussed above.

This force to move more of the latch mating element 1518 of the security belt 1560 into and along the belt path 1536 may be lower, and may be much lower, than the force to move the latch mating element 1518 out of the belt path 1536. Thus, for example, this lower force may be manageably exerted in one embodiment by a person, such that the person may tighten the latch mating element 1518 and thus constrict the belt path wall 1540 of the belt assembly 1550 around a bottle neck. In embodiments where the magnetically actuable latch 1512 has multiple protrusions 1551 and the latch mating element 1518 has multiple juts 1592 or other one or more protrusions, the opposing forces caused by all protrusions 1551 and juts 1592 in contact may need to be overcome. This force may still be such that a person can manageably force the latch mating element 1518 further into and along the belt path 1536.

Figure 13:
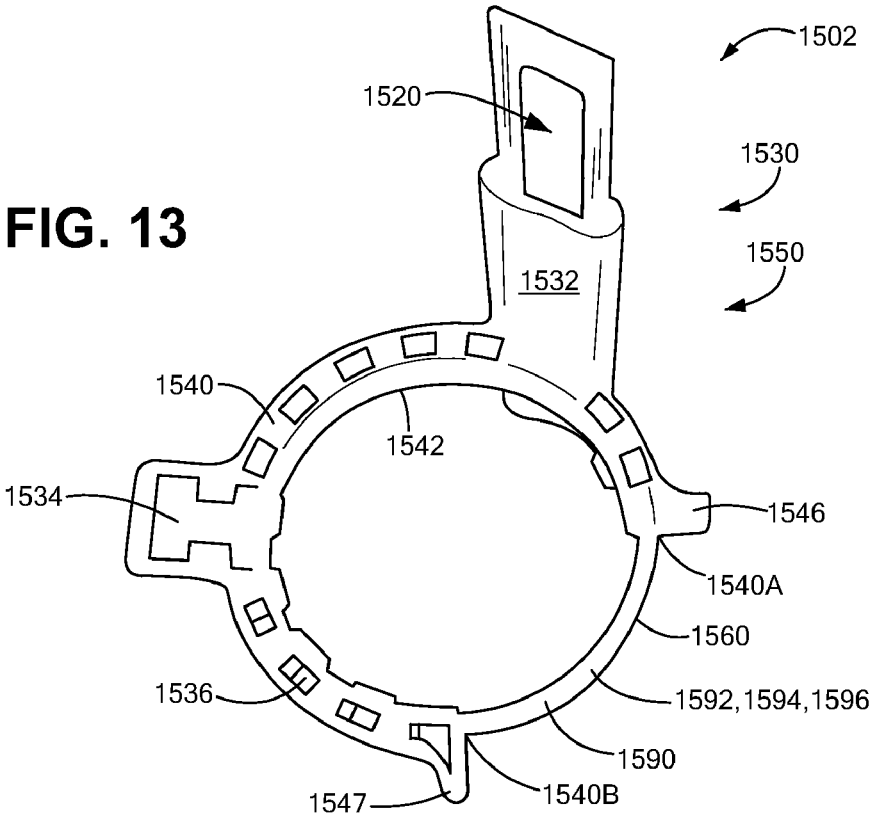
FIG. 13 illustrates a perspective view of a portion of a belt assembly, in accordance with one embodiment.

FIG. 13 illustrates a perspective view of a portion of a belt assembly 1550 showing the security tag 1520. Referring to FIG. 13 along with FIGS. 10-12, the security tag chamber 1532 of the housing may be shaped to enclose a security tag, such as the security tag 1520. In one embodiment, the security tag 1520 is a slender elongated member, and the security tag chamber 1532 has perimeter walls that delineate an internal void shaped to closely hold the security tag 1520. However, in various other embodiments, the security tag chamber 1532 may be variously configured to enclose or otherwise secure the security tag 1520 or a security tag of any other shape.

The security tag chamber 1532 may be secured to the belt path wall 1540 or otherwise with the rest of the housing 1530, such as by any way described above with respect to the locking mechanism pouch 1531 above. In one embodiment, the security tag chamber 1532 may be slidably affixed to the belt path wall 1540. As secured, the security tag chamber 1532 may prevent or increase the difficulty of removing the security tag 1520 from the housing 1530 and thus any bottle that may be secured to the bottle security device 1502.

The locking mechanism cover 1534, such as shown in FIGS. 10-11, may comprise a structure configured to be positioned on the locking mechanism pouch 1531 and over the flexible element 1516 and at least a portion, such as an exposed portion, of the magnetically actuable latch 1512. The locking mechanism cover 1534 may be secured to the belt assembly 1550 such as by any way described above with respect to locking mechanism pouch 1531 or otherwise herein. As secured, the locking mechanism cover 1534 may prevent or increase the difficulty of removing the magnetically actuable latch 1512 from the housing 1530.

In one embodiment, the locking mechanism pouch 1531 and the locking mechanism cover 1534 may, as secured, be called a locking mechanism chamber. The locking mechanism chamber may at least partially enclose and thereby secure the magnetically actuable latch 1512 and the flexible element 1516 of the locking mechanism 1510 to the bottle security device 1502.

Referring to FIGS. 10-14, the belt path 1536 may comprise a belt path wall 1540 and a belt path 1536 delineated by the belt path wall 1540. The belt path wall 1540 may be configured with a shape and material or materials allowing the belt path wall 1540 to constrict around a bottle neck or other article to thereby secure the bottle to the housing 1530 and thus the bottle security device 1502. In one embodiment, the belt path wall 1540 may include a portion of the security belt 1560.

In one embodiment, the portion of the belt path wall 1540 that may contact a bottle secured by the bottle security device 1502 is the bottle securing surface 1542. In an embodiment, the bottle securing surface 1542 may have at least a portion of an annulus or another curved shape that may conform to the bottle belt channel 1568 and to tighten the bottle hat 1570 around a circular or otherwise curved shape of a bottle neck when constricted. In one embodiment, the bottle securing surface 1542 may constrict directly around the bottle neck, and the bottle hat 1570 may not be used.

In one embodiment, the belt path wall 1540 may comprise a plastic or other material or materials that are bendable, extendable, deformable, or otherwise capable of such constriction. In one embodiment, the belt path wall 1540 comprises a material capable of such and constriction and which is at least somewhat resilient. Such a configuration may allow the belt path wall 1540 to return to its unconstricted shape or a similar shape such that the bottle security device may be reused.

The belt path wall 1540 may also be shaped to receive the security belt 1560 described herein. In one embodiment, the belt path wall 1540 delineates an annular or otherwise curved belt path 1536 of a substantially uniform thickness. This belt path 1536 may have substantially the same curve as the exterior of the belt path wall 1540 in one embodiment. However, in other embodiments, the belt path wall 1540 may have various thicknesses and alignments. Such varying thicknesses and alignments may be accomplished without changing the shape of the bottle securing surface 1542 by varying the configuration of one or more other surfaces of the belt path wall 1540.

In one embodiment, the belt path wall 1540 may be configured to be constricted around the bottle hat 1570, which may surround at least a portion of the bottle and may thus constrict around the bottle. Such a configuration may thus secure the bottle to the bottle hat 1570 and belt path wall 1540, and thus to the bottle security device 1502. The bottle securing surface 1542 may be shaped such that it can be partially disposed in the belt receiving channel or channels (e.g., 1586 of the leg 1581) of the one or more legs 1581-1583. In one embodiment, the bottle securing surface 1542 includes one or more ridges 1544 configured to extend into the one or more grooves (e.g., 1590 of the leg 1581) of the legs 1581-1583, which may align the bottle securing surface 1542 with the bottle hat 1570 when disposed around it.

The belt path wall 1540 may include two ends 1540A and 1540B. In one embodiment, handles 1546 and 1547 extend from the two ends 1540A and 1540B, and may facilitate constricting the belt.

The security belt 1560 may be shaped such that it may be fed into and along the belt path. In one embodiment, at least part of the security belt 1560 is an elongated element that may be curved in shape. The security belt 1560 may be, in one embodiment, shaped with a curve that is the same or similar to that of the belt path 1536, which may facilitate moving it along the belt path 1536. However, the security belt 1560 may be otherwise shaped.

In various embodiments, security belt 1560 may comprise one or more materials in any configuration. For example, in one embodiment, the security belt 1560 includes a plastic outer layer and metal inner layer. The metal and plastic components may separable or inseparable. For example, the metal and plastic components may be bonded, press-fit, co-molded, inserted, and/or coated. The metal portion may strengthen the security belt 1560 and prevent or inhibit breaking or otherwise separating portions of the security belt 1560, and thus prevent or inhibit unlocking the bottle security device 1502 from any bottle to which it may be secured. The metal may be beaded, stranded, flat-wire, partially cylindrical, or may be formed in any suitable way to reinforce the security belt 1560 and possibly also to allow or provide flexibility in the security belt 1560.

The security belt 1560 may be integral with or otherwise attached to the belt assembly 1550. For example, in one embodiment, the security belt 1560 is integral with or otherwise attached to the belt assembly 1550 within the belt path 1536 to the belt path wall 1540 at one of the ends of the security belt 1560. In this embodiment, the security belt 1560 may extend, from its attached end, out the end 1540A of the belt path 1536 and then back into the belt path 1536 at the end 1540A. Thus, the security belt 1560 may branch the two ends 1540A and 1540B such that the belt path wall 1540 and security belt 1560 may continuously surround a portion, such as the neck, of a bottle. However, in one embodiment, the two ends 1540A and 1540B may be positioned at any points along the circumference of the belt assembly 1550. For example, the end 1540A may comprise or be adjacent a side of the locking mechanism pouch 1531, and 1540A may be located at or near or at an opposite side.

In one embodiment, the handles 1546 and 1547 may be engaged and urged toward each other to move the attached security belt 1560 farther into and along the belt path 1536 to constrict the belt path wall 1540 about a bottle neck or other portion. As described below, when moving in this direction, portions of the latch mating element 1518 that may include the security belt 1560 may contact but move past the magnetically actuable latch 1512 without significant resistance. However, movement in the opposite direction may be prevented or met with greater resistance such that the belt path wall 1540 may remain in the constricted position after the handles 1546 and 1547 have been released. Thus, the security belt 1560 and belt path wall 1540 may cooperate to fixedly secure the bottle mouth and portion of the neck to the bottle security device 1502. In one embodiment, forcibly removing such a configured bottle security device 1502 may break the bottle, since the force to remove the bottle security device 1502 may be greater than the force to break the bottle, such as where the bottle is formed of glass.

Figure 19:
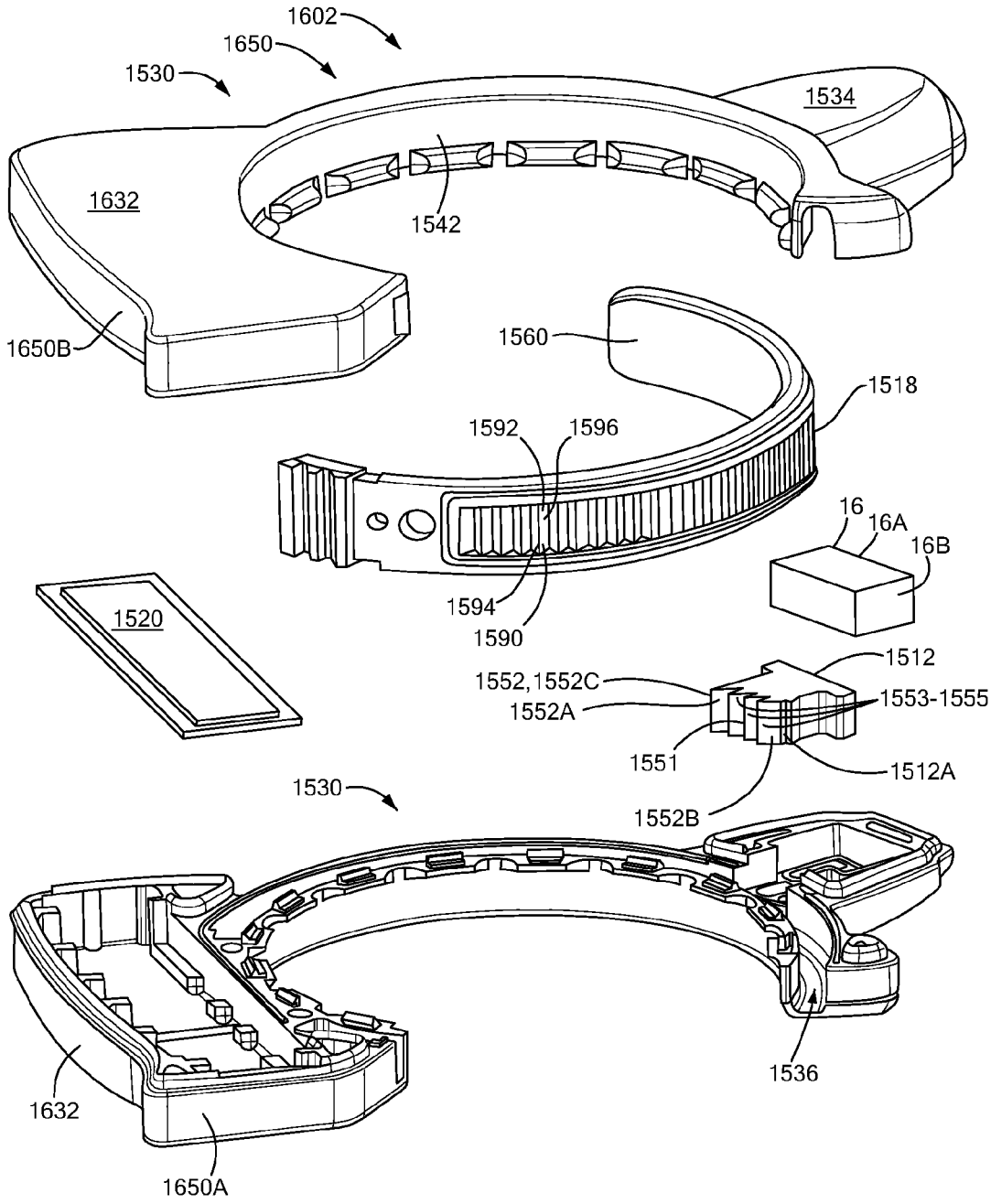
FIG. 19 illustrates an exploded view of a belt assembly, in accordance with one embodiment.

FIGS. 15-19 illustrate a perspective, top, side, side, and exploded view of a bottle security device 1602, in accordance with one embodiment. The security device 1602 may be similarly configured with a housing 1530 but may include a security tag chamber 1632 that may be disposed sideways in the belt assembly 1650 relative to the positioning of the security tag chamber 1532 in the belt assembly 1550 described above. The belt assembly 1650 may include a bottom housing 1650A and top housing 1650B that may welded, fused, snap-fit or otherwise secured together to provide resistance to or prevent at attempt to open it. As can be seen in FIG. 19, the magnetically actuable latch 1512 includes a tamper-defeat notch 1512A which prevents insertion of an implement into the belt path 1536 to defeat the device.

Figure 20:
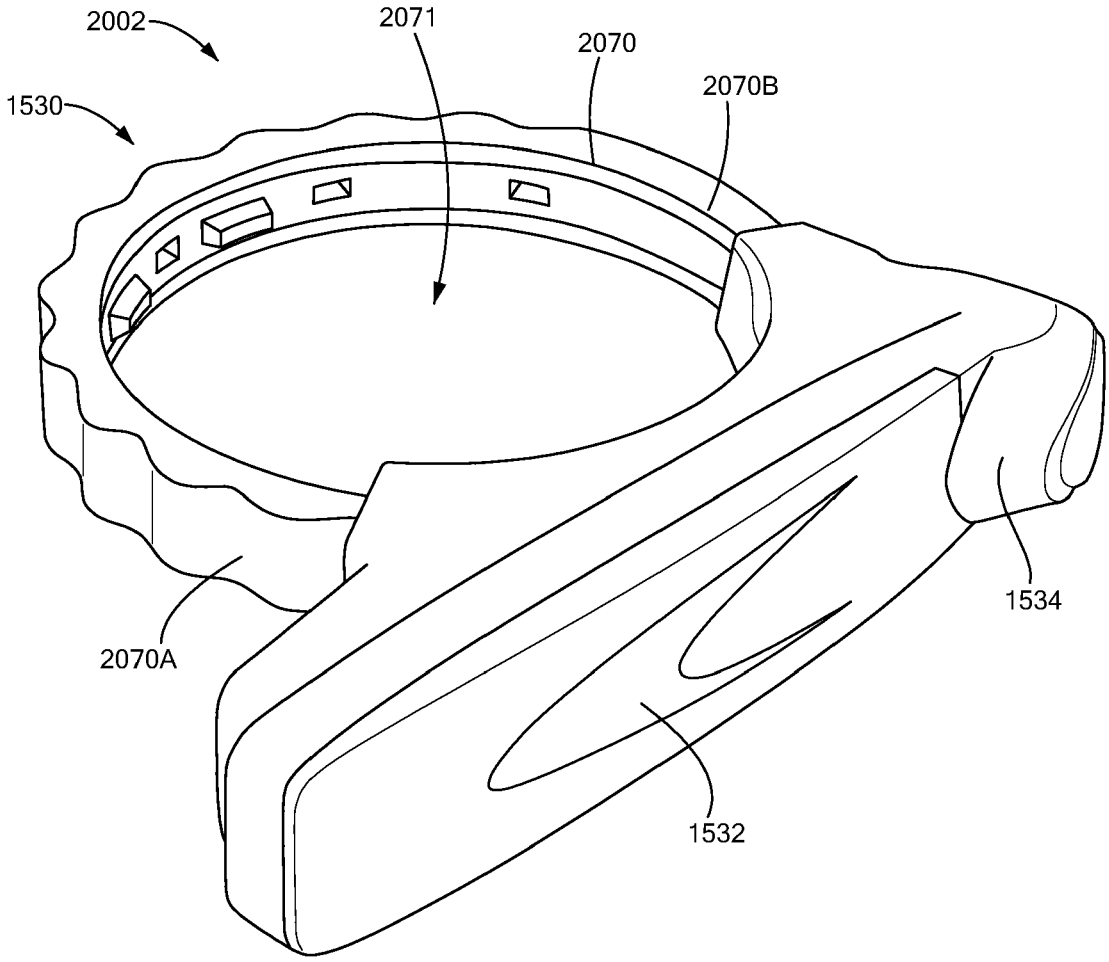
FIG. 20 illustrates a perspective view of a security device for a bottle, in accordance with one embodiment.
Figure 21:
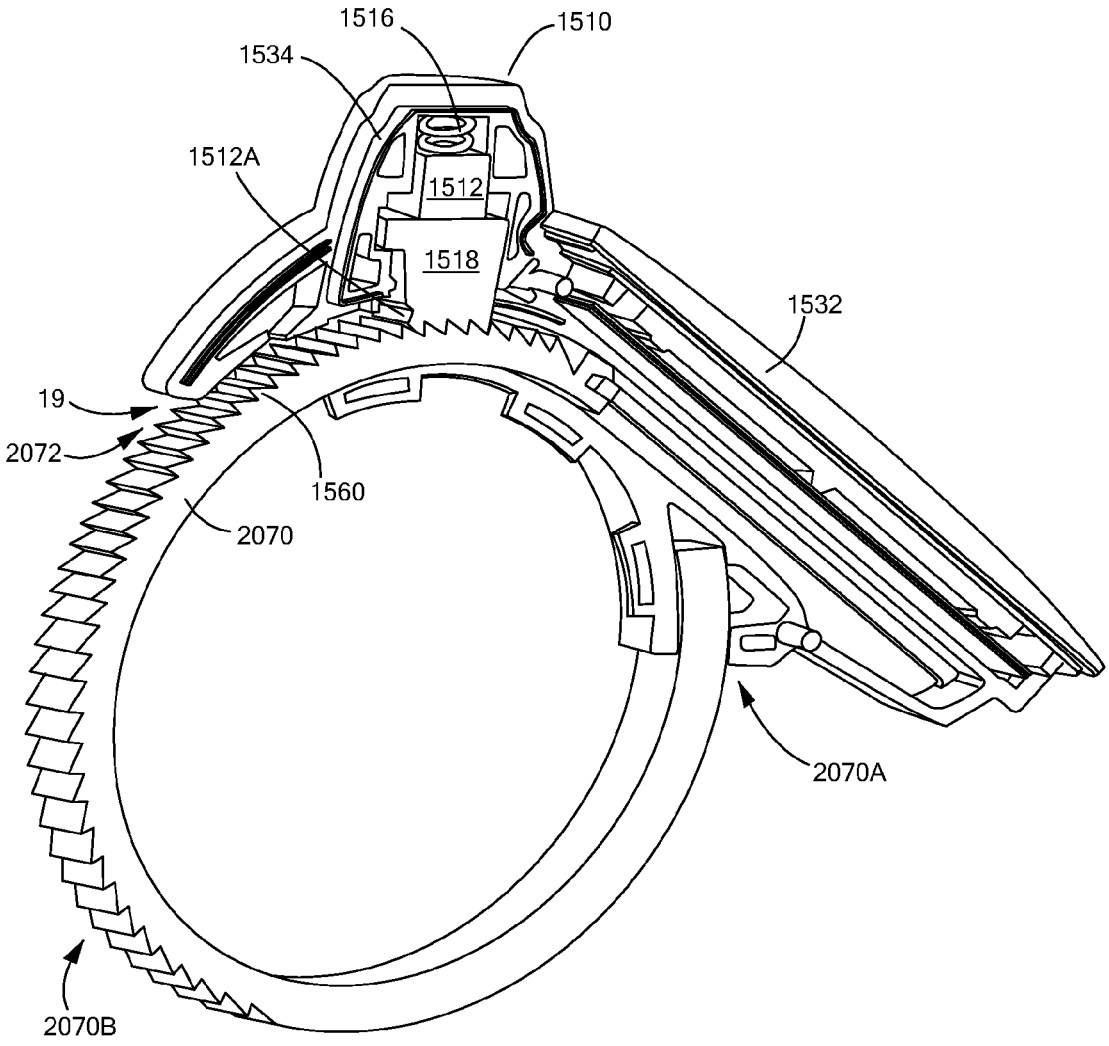
FIG. 21 illustrates a partial cross-sectional perspective view of the embodiment shown in FIG. 20.
Figure 22:
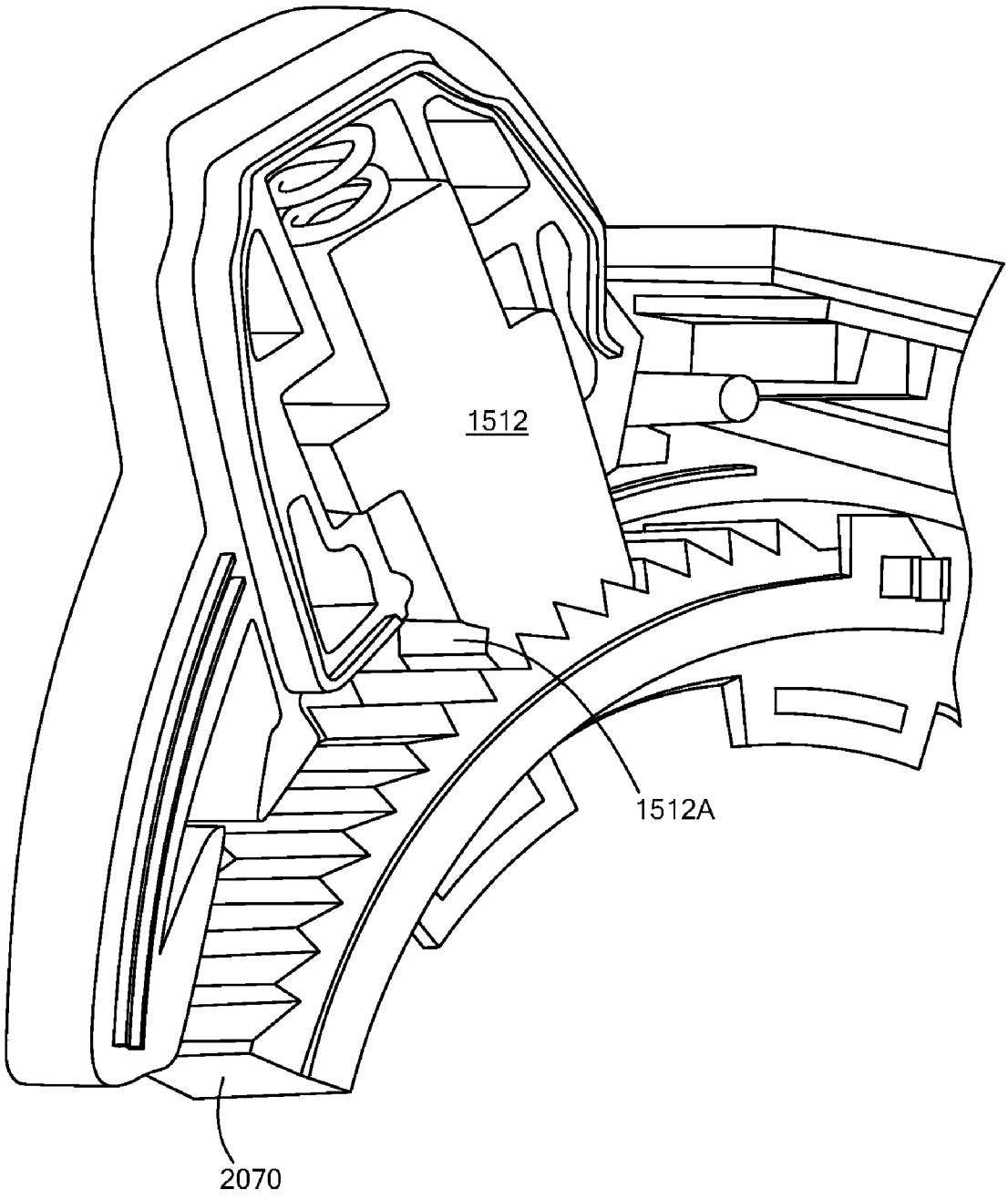
FIG. 22 illustrates a partial cross-sectional perspective view of the latch mechanism of the embodiment shown in FIG. 20.
Figure 23:
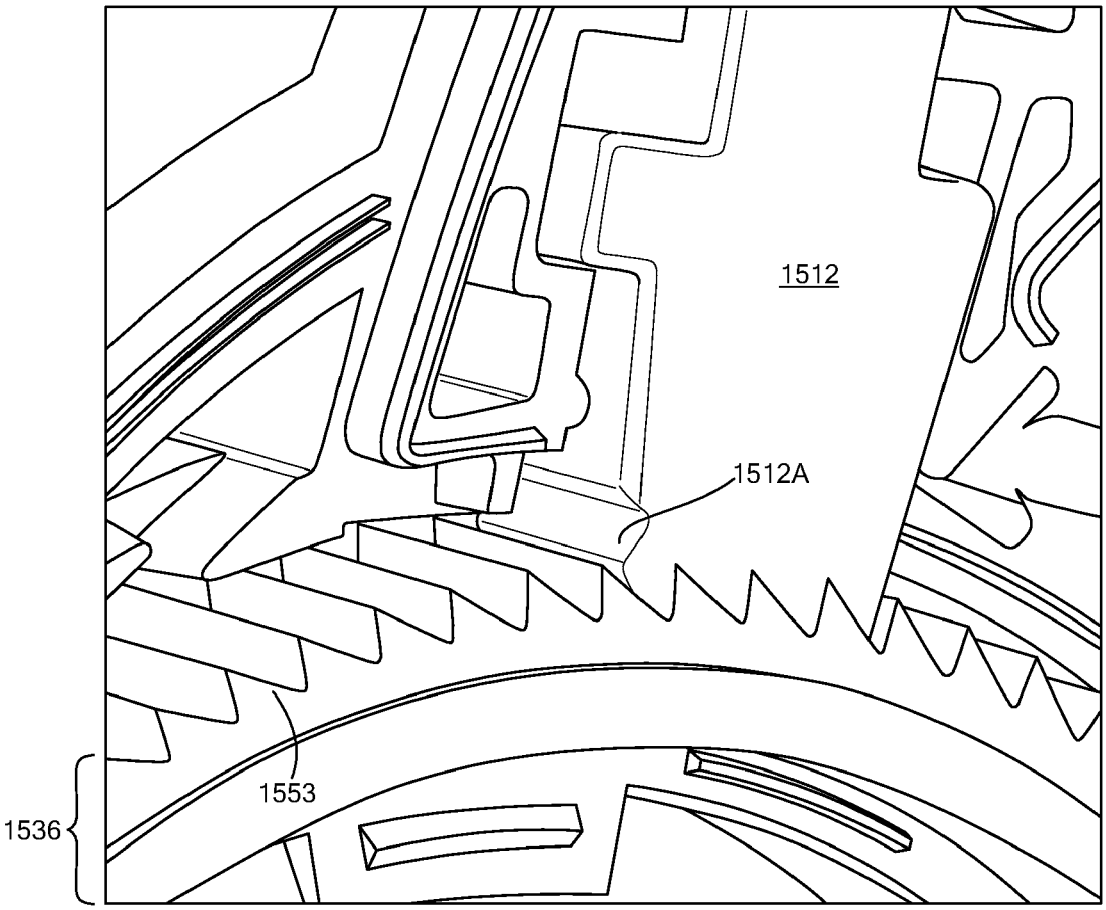
FIG. 23 illustrates a partial close-up cross-sectional perspective view of the latch mechanism of the embodiment shown in FIG. 20.

FIGS. 20-24 illustrate an embodiment of a security device 2002 in which the housing is 1530 configured with locking mechanism cover 1534 adjacent to the security tag chamber 1532. The security tag chamber 1532 contains a detectable element such an EAS label. FIG. 21 depicts a partial cross-sectional view of the locking mechanism 1510 and the security tag chamber 1532. As in the embodiments described previously, the locking mechanism 1510 may include a magnetically actuable latch 1512, a flexible element 1516, and a latch mating element 1518. The flexible element 1516 may be configured as a coil or other spring or like member. In the illustrated embodiment, the flexible member 1516 is a coil spring. The housing includes a passageway therein which provides a belt pathway to slidingly receive the security belt 1560. In the illustrated embodiment, the housing includes an aperture 2072 contiguous to the belt pathway, and the security belt 1560 can be inserted into the belt pathway through the aperture 2072.

The housing includes a locking member 2070 movable between an open or expanded position (FIG. 21) and a closed position (FIG. 20). In the closed position, the locking member 2070 provides an annular opening 2071 adapted to engage the neck of a bottle. In one embodiment, the locking member 2070 includes a proximal end 2070A fixedly attached to the housing (or integrally formed with the housing), and a free distal end 2070B which has at least a portion of the security belt 1560 extending there from. In the illustrated embodiment, the proximal end 2070A is pivotally attached to the housing, allowing the locking member 2070 to be rotated outward to open the device. The locking member 2070 shown in FIGS. 20-21 has a semi-annular configuration and is formed in from a rigid material. In other embodiments, the locking member 20 can be formed from other materials and in different configurations, depending on the nature of the article to be protected.

The security belt 1560 can be selectively inserted through the aperture 2072 into the belt pathway to form the annular opening 2071. In the illustrated embodiment, the open locking member 2070 is rotated inward until the security belt 1560 is inserted into the aperture 2072 and can be engaged with the latch 1512 via latch mating element 1518. The magnetically actuable latch 1512 includes a front surface 13 which has a laterally-positioned tamper-defeat notch 1512A formed therein. The tamper-defeat notch 1512A is configured to be coincident with belt pathway and is accessible through the aperture 2072.

The function of the tamper-defeat notch 1512A will now be described in relation to the embodiment of FIGS. 20-24, as well as the previous embodiments shown in FIGS. 10-14 which include the tamper-defeat notch 1512A. Although embodiments of the present invention are described herein in relation to a bottle tag implementation, the principles of the present invention are not limited to such. The present invention may also apply to any irregularly shaped object having a shaft or other shape/configuration where a belt-based security tag would work.

Figure 24:
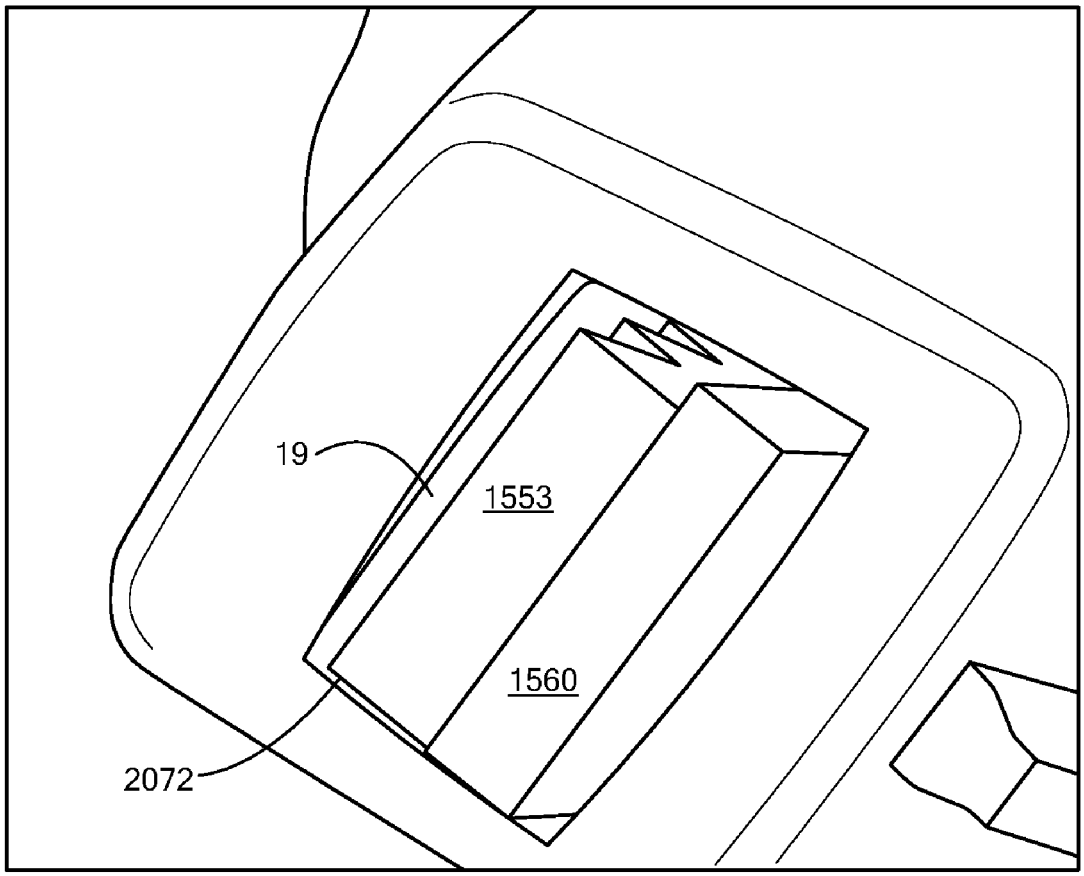
FIG. 24 is a partial view of the embodiment shown in FIG. 20 illustrating the accessible gap in the housing.

As can be best seen in FIG. 24, a slight gap 19 in the aperture 2072 may exist between the security belt 1560 and the belt path 1536. The gap 19 extends to the latch 1512, and may provide a vulnerability which enables a would-be shoplifter to defeat the device by the insertion of an unauthorized object through the aperture 2072 and into the gap 19 in an attempt to lift or pry the latch out of position.

In operation, absent the tamper-defeat notch 1512A, it is possible to insert a thin metal strip between the strap and the plastic housing and urge the metal strip forward into the gap 19 until it is lodged between the latch 1512 and the security belt 1560. Once the metal strip is positioned underneath the teeth of the latch 12, the device can be easily opened by urging the latch 1512 upward to disengage the teeth.

The addition of the tamper-defeat notch 1512A to the latch 1512 advantageously provides a cost effective and simple solution to this problem. The tamper-defeat notch 1512A is positioned and configured within the latch 1512 to be coincident with the space between the belt path 1536 and the belt teeth 1553 so that any object inserted into the belt path 1535 is guided into the tamper-defeat notch 1512A. In the illustrated embodiments, the tamper-defeat notch 1512A is shown as having a symmetrical V-configuration, however the invention is not limited in this regard. The tamper-defeat notch 1512A can have any sort of concave configuration, such as a U or square-shaped notch.

Figure 25:
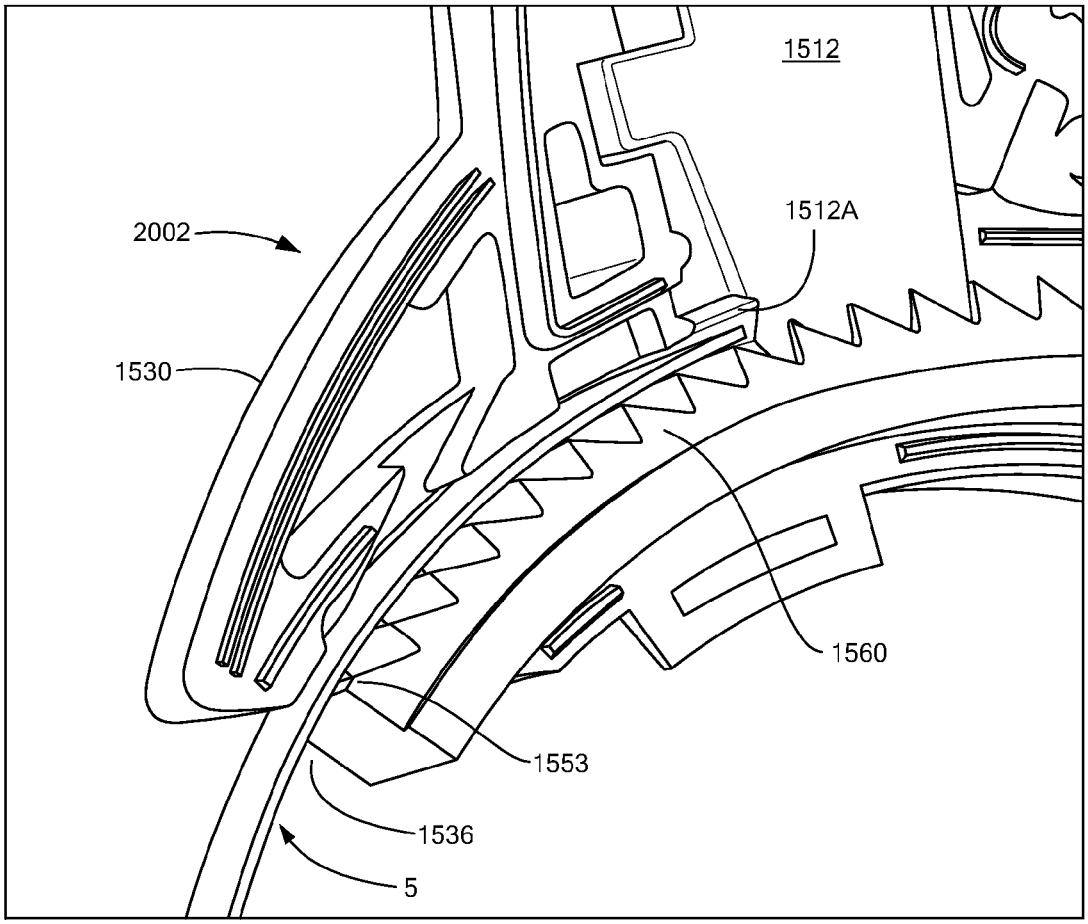
FIG. 25 depicts an attempt to defeat the device of FIG. 20 using a thin metal strip.

FIG. 25 illustrates an example of an attempt to defeat the device 2002 by the insertion of thin metal strip 5 into the belt path 1536. In order to unlock the device 2002, the metal strip 5 needs to be positioned so as to urge the latch 1512 upward in order to disengage it from the teeth 1553. The tamper-defeat notch 1512A advantageously changes the contact angle of the un-authorized object 5 and the latch 1512, and causing the metal strip 5 to exert a downward vertical force component on the latch mechanism. This downward vertical component only serves to more strongly engage further engaging the latch to the strap, thereby maintaining a secure assembly.

Figure 26:
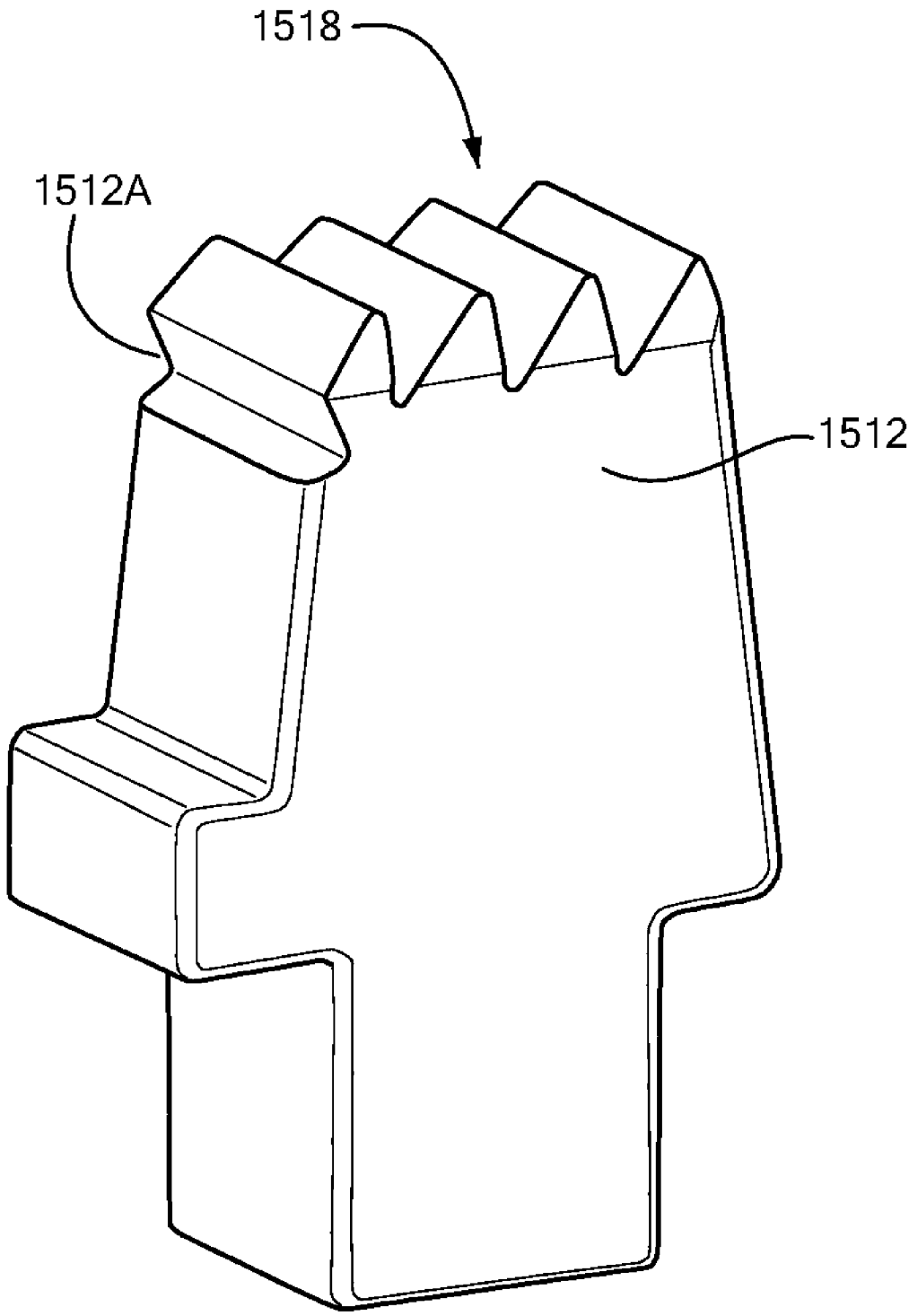
FIG. 26 is a perspective view of a notched latch in accordance with principles of the present invention.

FIG. 26 shows a close-up perspective view of the latch 1512 of the present invention. In particular, FIG. 26 shows notch 1512A on latch 1512 in one embodiment of the present invention.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A security device comprising:

a belt having a latch mating element;

a magnetically actuable locking mechanism, the locking mechanism including:

a magnetically actuable latch, the latch including a lower surface having at least one protrusion extending there from and adapted to engage with the latch mating element of the belt, and a front surface adjacent the lower surface, the front surface having a lateral notch formed therein; and a flexible element to bias the magnetically actuable latch and the belt into a locked position; and a housing having the magnetically actuable latch disposed therein, the housing including a passageway therein defining a belt pathway configured to slidingly receive the belt therein.

2. The security device of claim 1, wherein the notch has V-shaped configuration.

3. The security device of claim 1, wherein the notch has a U-shaped configuration.

4. The security device of claim 1, wherein the housing further includes a chamber for containing a detectable security element.

5. The security device of claim 4, wherein the detectable security element includes components comprising an Electronic Article Surveillance ("EAS") tag.

6. The security device of claim 1, wherein the housing includes a locking member movable between an open position and a closed position wherein the locking member is configured to provide an annular opening in the closed position, the annular opening being adapted to engage a substantially cylindrical portion of an object to be secured.

7. The security device of claim 6, wherein the housing includes an aperture, and wherein the belt is insertable into the belt pathway through the aperture in the housing, and wherein the locking member includes a proximal end fixedly attached to the housing and a free distal end, the distal end having at least a portion of the belt extending there from, wherein the belt can be selectively inserted through the aperture and into the belt pathway.

8. The security device of claim 7, wherein the notch is configured to be coincident to the belt pathway and is accessible through the aperture.

9. The security device of claim 8, wherein the notch is configured such that an object inserted into the belt pathway is guided into the notch, thereby preventing the object from unlocking the security device.

10. The security device of claim 9, wherein insertion of an object into the belt pathway engages the notch and exerts a downward vertical force component on the locking mechanism, further engaging the magnetically actuable latch to the belt.

11. A security device, comprising:

a belt having a latch mating element;

a magnetically actuable locking mechanism, the locking mechanism including:

a magnetically actuable latch, the magnetically actuable latch including a front surface having a lateral notch formed therein; and a flexible element to bias the magnetically actuable latch and the belt into a locked position; and a housing having the magnetically actuable locking mechanism disposed therein, the housing including a passageway therein defining a belt pathway configured to slidingly receive the belt therein, the lateral notch being arranged to guide an object inserted into the belt pathway into the lateral notch.

12. The security device of claim 11, wherein the housing includes an aperture and a locking member movable between an open position and a closed position wherein the locking member is configured to provide an annular opening in the closed position, the annular opening being adapted to engage a substantially cylindrical portion of an object to be secured, and wherein the belt is insertable into the belt pathway through the aperture in the housing, and the locking member includes a proximal end fixedly attached to the housing and a free distal end, the distal end having at least a portion of the belt extending there from, wherein the belt can be selectively inserted through the aperture and into the belt pathway.

13. The security device of claim 11, wherein insertion of an object into the belt pathway engages the notch and exerts a downward vertical force component on the locking mechanism, further engaging the magnetically actuable latch to the belt.

14. A method for protecting an article from theft, the method comprising:

affixing a security device around a circumference of the article, the security device including:

a belt having a latch mating element;

a magnetically actuable locking mechanism, the locking mechanism including:

a magnetically actuable latch, the latch including a lower surface having at least one protrusion extending there from and adapted to engage with the latch mating element of the belt, and a front surface adjacent the lower surface, the front surface having a lateral notch formed therein; and a flexible element to bias the magnetically actuable latch and the belt into a locked position; and a housing having the magnetically actuable locking mechanism disposed therein, the housing including a passageway therein defining a belt pathway configured to slidingly receive the belt therein, the belt securely encompassing the circumference of the article when in the locked position.

15. The method of claim 14, wherein the housing includes a locking member movable between an open position and a closed position wherein the locking member is configured to provide an annular opening in the closed position, the annular opening being adapted to engage the circumference of the secured article.

16. The method of claim 15, wherein the housing includes an aperture, wherein belt is insertable into the belt pathway through the aperture in the housing, wherein the locking member includes a proximal end fixedly attached to the housing and a free distal end, the distal end having at least a portion of the belt extending there from, wherein the belt can be selectively inserted through the aperture and into the belt pathway, and wherein the notch is configured to be coincident to the belt pathway and is accessible through the aperture.

17. The method of claim 16, wherein the notch is configured such that an object inserted into the belt pathway is guided into the notch, thereby preventing the object from unlocking the security device.

18. The method of claim 17, wherein insertion of an object into the belt pathway engages the notch and exerts a downward vertical force component on the locking mechanism, further engaging the magnetically actuable latch to the belt.

* * * * *